US006847270B2

(12) United States Patent
Yoneda et al.

(10) Patent No.: US 6,847,270 B2
(45) Date of Patent: Jan. 25, 2005

(54) WAVEGUIDE GROUP BRANCHING FILTER

(75) Inventors: Naofumi Yoneda, Tokyo (JP); Moriyasu Miyazaki, Tokyo (JP); Kousaku Yamagata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 194 days.

(21) Appl. No.: 10/018,573

(22) PCT Filed: Mar. 15, 2001

(86) PCT No.: PCT/JP01/02071

§ 371 (c)(1),
(2), (4) Date: Dec. 20, 2001

(87) PCT Pub. No.: WO01/95423

PCT Pub. Date: Dec. 13, 2001

(65) Prior Publication Data

US 2003/0006866 A1 Jan. 9, 2003

(30) Foreign Application Priority Data

Jun. 5, 2000 (JP) ..... 2000-168043

(51) Int. Cl.[7] ..... H01P 5/12

(52) U.S. Cl. ..... 333/135; 333/126; 333/21 R; 333/121; 333/122

(58) Field of Search ..... 333/126, 129, 333/132, 134, 135, 21 R, 21 A, 212, 248, 121, 117, 122

(56) References Cited

U.S. PATENT DOCUMENTS

| | | | | |
|---|---|---|---|---|
| 3,731,236 A | * | 5/1973 | Di Tullio et al. | 333/126 |
| 3,816,835 A | | 6/1974 | Hai et al. | |
| 3,838,362 A | * | 9/1974 | Kurtz | 333/135 |
| 4,047,128 A | * | 9/1977 | Morz | 333/122 |

(List continued on next page.)

FOREIGN PATENT DOCUMENTS

| | | | | |
|---|---|---|---|---|
| EP | 0 295 812 A2 | | 12/1988 | |
| EP | 834953 A1 | * | 4/1998 | ..... H01P/1/161 |
| JP | 63-166301 | | 7/1988 | |
| JP | 63-269601 A | | 11/1988 | |
| JP | 5-102702 A | | 4/1993 | |
| JP | 7-22803 A | | 1/1995 | |
| JP | 7-58519 A | | 3/1995 | |
| JP | 9-27702 A | | 1/1997 | |
| JP | 10-28003 A | | 1/1998 | |

OTHER PUBLICATIONS

Uher et al., waveguide Components for Antenna Feed Systems: Theory and CAD, pp. 420–434 (1993).

Yoneda et al., IEEE MTT–S Digest, pp. 1449–1452 (2000).

Yoneda et al., A Grooved Circular waveguide Polarizer, pp. 96 (2000) w/ English Translation of Relevant Part.

*Primary Examiner*—Robert Pascal
*Assistant Examiner*—Kimberly E Glenn
(74) *Attorney, Agent, or Firm*—Birch, Stewart, Kolasch & Birch, LLP

(57) ABSTRACT

The waveguide group branching filter according to the present invention is formed by boring out of two metal blocks constituent circuits including a circular-to-square waveguide multistage transformer 1, the branch waveguide polarizer/branching filter 4, a rectangular waveguide multistage transform 9, the rectangular waveguide H-plane T-branch circuit 10, and waveguide band-pass filters 8, 14 and 18; radio waves V1 and H1, which have their polarization planes vertical and horizontal, respectively, to the branching plane of the branch waveguide polarizer/branching filter 4 in a certain frequency band f1, and a radio wave V2 of the same polarization plane as that of the radio wave V1 in a frequency band f2 higher than the frequency band f1 are incident to an input port P1, and the radio wave V1 is emitted from an output port P2, the radio wave H1 from an output port P3 and the radio wave V2 from an output port P4.

37 Claims, 14 Drawing Sheets

U.S. PATENT DOCUMENTS 4,099,145 A * 7/1978 Boujet ..... 333/21 R
4,467,294 A * 8/1984 Janky et al. ..... 333/126
4,912,436 A * 3/1990 Alford et al. ..... 333/135
4,999,591 A * 3/1991 Koslover et al. ..... 333/21 R
5,923,229 A * 7/1999 Simons ..... 333/135
6,087,908 A * 7/2000 Haller et al. ..... 333/122
6,191,670 B1 * 2/2001 Nguyen ..... 333/208
6,313,714 B1 * 11/2001 Junker et al. ..... 333/125
6,473,053 B1 * 10/2002 Krishmar-Junker et al. 343/772
6,496,084 B1 * 12/2002 Monte et al. ..... 333/121

* cited by examiner

CONVENTIONAL ART

B-B'
P4
A-A'
P2
P3
18
16
17
15
14
12
13
11
10
8
9
23
25
2
1
5
6
7
21
P1
A
A'
B
C
B'
C'
C-C'

D-D' CROSS-SECTION

○: POST-TYPE COUPLING HOLES 42 (2m+2=10)

△: RECTANGULAR CAVITY RESONATORS 43 (m=4)

D-D' CROSS-SECTION

○: DOUBLE-POST-TYPE COUPLING HOLES 19 (3m+3=15)

△: RECTANGULAR CAVITY RESONATORS 48 (m=4)

WAVEGUIDE GROUP BRANCHING FILTER

This application is the national phase under 35 U.S.C. § 371 of PCT International Application No. PCT/JP01/02071 which has an International filing date of Mar. 15, 2001, which designated the United States of America.

TECHNICAL FIELD

The present invention relates to a waveguide group branching filter that is used mainly in VHF, UHF, microwave and millimeter wave bands.

TECHNICAL FIELD

FIG. 1 is a perspective view showing a conventional waveguide group branching filter set forth, for example, in J. Bornemann, U. Rosenberg, "Waveguide Components for Antenna Feed Systems: Theory and CAD," ARTECH HOUSE INC., pp. 413–418, 1993. In FIG. 1, reference numeral 61 denotes a square main waveguide; 62*a* denotes coupling holes of the same shape formed through two opposed side walls of the square main waveguide 61 in symmetrical relation to each other; and 62*b* denotes coupling holes of the same shape formed symmetrically through two other opposed side walls of the square main waveguide 61 than those through which the coupling holes 62*a* are formed.

Furthermore, in FIG. 1, reference numeral 63*a* denotes two waveguide low-pass filters that branch off via the coupling holes 62*a* from longitudinal axis of the square main waveguide 61 at right angles to the axis thereof; and 63*b* denotes two waveguide low-pass filters that branch off via the coupling holes 62*b* from the square main waveguide 61 at right angles to the axis thereof. Reference numeral P1 denotes an input port of the square main waveguide 61; P2 denotes an output port of the square main waveguide 61; and 64 denotes a waveguide high-pass filter connected to the output port P2 and formed by two square waveguide steps.

Next, the operation of the prior art example will be described below.

Now, assume that a total of four kinds of radio waves, two orthogonal polarized waves in each of two different frequency bands, are incident via the input port P1 of the square main waveguide 61. The fundamental mode of that one of the radio waves in the lower frequency band whose polarization plane is vertical to the longitudinal axis of the waveguide low-pass filter 63*a*, that is, the TE10 mode, undergoes total reflection due to the cutoff effect of the waveguide high-pass filter 64 to form a standing wave in the square main waveguide 61, which couples equally with the fundamental modes of the opposed waveguide low-pass filters 63*a* through the coupling holes 62*a* and propagates in the waveguide low-pass filters 63*a*.

The fundamental mode of the radio wave in the lower frequency band whose polarization plane is vertical to the longitudinal axis of the waveguide low-pass filter 63*b*, that is, the TE01 mode, undergoes total reflection due to the cutoff effect of the waveguide high-pass filter 64 to form a standing wave in the square main waveguide 61, which couples equally with the fundamental modes of the two opposed waveguide low-pass filters 63 through the coupling holes 62*b* and propagates in the waveguide low-pass filters 63*b*. Further, the two radio waves of orthogonal polarization planes in the higher frequency band among the four kinds of incident radio waves scarcely couple with the coupling holes 62*a* and 62*b* due to the cutoff effect of the waveguide low-pass filters 63*a* and 63*b*, and they propagate in the waveguide high-pass filter 64, thereafter being emitted from the output port P2.

Suitable selection of the sizes and positions of the coupling holes 62*a* and 62*b* allows effective suppression of the reflection of the radio waves in the lower frequency band which are incident from the input port P1, and suitable selection of the waveguide diameter of each step and the step spacing of the waveguide high-pass filter 64 allows effective suppression of the reflection of the radio waves in the higher frequency band which are incident from the input port P1.

Since the conventional waveguide group branching filter has such a structure as described above, even if the two frequency bands incident from the input port P1 are widely spaced apart, vertical and bilateral symmetry of the circuit configuration completely suppresses the generation of a high-order mode which contributes greatly to unnecessary coupling of coupling holes, such as the TE11 or TM11 mode, in the branch section in the square main waveguide 61 (in the neighborhood of the coupling holes 62*a* and 62*b*)—this permits realization of a high-performance waveguide group branching filter with highly excellent reflection and polarized waves isolation characteristics.

The conventional waveguide group branching filter has such a construction as described above, and hence it requires a combiner circuit (not shown) for combining radio waves of the same polarization separated between the two opposed waveguide low-pass filters 63*b* and a combiner circuit (not shown) for combining radio waves of the same polarization similarly separated between the two waveguide low-pass filters 63*b*; accordingly, the entire circuit structure is very bulky and is difficult of miniaturization. Moreover, because of its cubic structure, the integral formation of respective components is not easy, giving arise to the problem of difficulty in the reduction of manufacturing costs.

The present invention is intended to solve such a problem as mentioned above, and has for its object to provide a high-performance waveguide group branching filter that can be made smaller and cheaper.

DISCLOSURE OF THE INVENTION

According to an aspect of the present invention, there is provided a waveguide group branching filter which comprises: a circular-to-square waveguide multistage transformer connected to an input port; a branch waveguide polarizer/branching filter connected to the circular-to-square waveguide multistage transformer; a first waveguide band-pass filter connected to a branching end of the branch waveguide polarizer/branching filter; a rectangular waveguide multistage transformer connected to one end of the branch waveguide polarizer/branching filter; a rectangular waveguide H-plane T-branch circuit; and second and third waveguide band-pass filters connected to the rectangular waveguide H-plane T-branch circuit; and in which a circuit structure composed of the circular-to-square waveguide multistage transformer, branch waveguide polarizer/branching filter, the rectangular multistage transformer, the rectangular waveguide H-plane T-branch circuit, and the first, second and third waveguide band-pass filters is formed by boring two metal blocks from their surfaces; and in which a first radio wave of a first frequency band which has the polarization plane perpendicular to the branch plane of said waveguide polarizer/branching filter, a second radio wave of the first frequency band which has the polarization plane parallel to the branch plane of the branch waveguide polarizer/branching filter, and a third radio wave of a second frequency band higher than the first one which has the same polarization plane as that of the first radio wave are incident to the input port, and the first radio wave, the second radio wave and the third radio wave arc emitted, respectively, from the third waveguide band-pass filter, the first waveguide band-pass filter and the second waveguide band-pass filter.

This structure permits realization of a high-performance waveguide group branching filter of highly excellent reflection and polarized waves isolation characteristics and, at the same time, facilitates its miniaturization and reduction of its manufacturing cost.

A waveguide group branching filter according to another aspect of the present invention has its branch waveguide polarizer/branching filter is formed by a square waveguide and one coupling hole formed through one side wall of the square waveguide at the branching end of the branch waveguide polarizer/branching filter.

This permits realization of a high-performance waveguide group branching filter that has highly excellent reflection and polarized waves isolation characteristics.

A waveguide group branching filter according to another aspect of the present invention has its branch waveguide polarizer/branching filter is formed by a square waveguide and two coupling holes formed through one side wall of the square waveguide at the branching end of the branch waveguide polarizer/branching filter.

This permits realization of a high-performance waveguide group branching filter that has more highly excellent reflection and polarized waves isolation characteristics.

A waveguide group branching filter according to another aspect of the present invention has its branch waveguide polarizer/branching filter is formed by a square waveguide, one coupling hole formed through one side wall of the square waveguide at the branching end of the branch waveguide polarizer/branching filter and a thin metal sheet inserted in the square waveguide.

This permits realization of a high-performance waveguide group branching filter that has highly excellent reflection and polarized waves isolation characteristics over a wide band.

A waveguide group branching filter according to another aspect of the present invention has its branch waveguide polarizer/branching filter is formed by a square waveguide, two coupling holes formed through one side wall of the square waveguide at the branching end of the branch waveguide polarizer/branching filter and a thin metal sheet inserted in the square waveguide.

This permits realization of a high-performance waveguide group branching filter that has highly excellent reflection and polarized waves isolation characteristics over a wider band.

According to another aspect of the present invention, the waveguide group branching filter is provided with a circularly polarized wave generator connected between the input port and the circular-to-square waveguide multistage transformer and composed of a circular waveguide and a dielectric plate inserted in the circular waveguide, the circuit structure including the circularly polarized wave generator being formed by boring two metal blocks from their surfaces.

This structure provides for the generation of right- and left-handed polarized waves from the radio waves incident to the input port become right-hand left-handed polarized waves, and facilitates miniaturization and cost reduction of the waveguide group branching filter.

According to another aspect of the present invention, the waveguide group branching filter is provided with a circularly polarized wave generator connected between the input port and the circular-to-square waveguide multistage transformer and composed of a circular waveguide and a plurality of metal pins mounted on the side wall of the circular waveguide, the circuit structure including the circularly polarized wave generator being formed by boring two metal blocks from their surfaces.

This structure provides for the generation of right- and left-handed polarized waves from the radio waves incident to the input port become right- and left-handed polarized waves, and facilitates miniaturization and cost reduction of the waveguide group branching filter.

According to another aspect of the present invention, the waveguide group branching filter is provided with a circularly polarized wave generator connected between the input port and the circular-to-square waveguide multistage transformer and composed of a circular waveguide and a plurality of grooves cut in the side wall of the circular waveguide, the circuit structure including the circularly polarized wave generator being formed by boring two metal blocks from their surfaces.

This structure provides for the generation of right- and left-handed polarized waves from the radio waves incident to the input port, and facilitates miniaturization and cost reduction of the waveguide group branching filter.

According to another aspect of the present invention, the waveguide group branching filter has its first waveguide band-pass filter formed by n rectangular cavity resonators and n iris-type coupling holes, has its second waveguide band-pass filter formed by m rectangular cavity resonators and m+1 iris-type coupling holes, and has its third waveguide band-pass filter formed by n rectangular cavity resonators and n+1 iris-type coupling holes.

This structure permits realization of a high-performance waveguide group branching filter with excellent reflection and polarized waves isolation characteristics.

According to another aspect of the present invention, the waveguide group branching filter has its second waveguide band-pass filter formed by m rectangular cavity resonators and 2m+2 post-type coupling holes, or has its third waveguide band-pass filter formed by n rectangular cavity resonators and 2n+2 post-type coupling holes.

This structure is free from curved portions unavoidable in boring a metal block from its surface, providing increased design accuracy and making steeper the attenuation characteristic of the pass band in the lower frequency side thereof.

According to another aspect of the present invention, the waveguide group branching filter has its second waveguide band-pass filter formed by m rectangular cavity resonators and 3m+3 double-post-type coupling holes, or has its third waveguide band-pass filter formed by n rectangular cavity resonators and 3n+3 double-post-type coupling holes.

This structure is free from curved portions unavoidable in boring a metal block from its surface, providing increased design accuracy and allowing ease in metal working.

According to another aspect of the present invention, the waveguide group branching filter has its first or third waveguide band-pass filter replaced with a waveguide low-pass filter formed by a corrugated or stepped rectangular waveguide.

This permits further miniaturization of the waveguide group branching filter.

According to another aspect of the present invention, the waveguide group branching filter has its second waveguide band-pass filter replaced with a waveguide high-pass filter formed by a corrugated or stepped rectangular waveguide.

This permits further miniaturization of the waveguide group branching filter.

According to another aspect of the present invention, the waveguide group branching filter is provided with a rectangular waveguide E-plane T-branch circuit connected to the branching end of the branch waveguide polarizer/branching filter and the first waveguide band-pass filter, and a fourth waveguide band-pass filter connected to the rectangular waveguide E-plane T-branch circuit, and in which a circuit structure composed of the rectangular waveguide E-plane T-branch circuit and the fourth waveguide band-pass filter is formed by boring two metal blocks from their surfaces, and in which a fourth radio wave of the second frequency band which has the same polarization plane as that of the second radio wave is incident to the input port, the fourth radio wave being emitted from the fourth waveguide band-pass filter.

This structure permits realization of a high-performance waveguide group branching filter that enables group branching of four kinds of radio waves, has highly excellent reflection and polarized waves isolation characteristics and, at the same time, facilitates its miniaturization and reduction of its manufacturing cost.

According to another aspect of the present invention, the waveguide group branching filter has its first and third waveguide band-pass filters each formed by n rectangular cavity resonators and n+1 iris-type coupling holes, and has its second and fourth waveguide band-pass filters each formed by m rectangular cavity resonators and m+1 iris-type coupling holes.

This structure permits realization of a high-performance waveguide group branching filter of excellent reflection and polarized waves isolation characteristics.

According to still another aspect of the present invention, the waveguide group branching filter has its fourth waveguide band-pass filter replaced with a waveguide high-pass filter formed by a corrugated or stepped rectangular waveguide.

This structure permits realization of a waveguide group branching filter that has a smaller pseudo-planar circuit structure.

BEST MODE FOR CARRYING OUT THE INVENTION

To facilitate a better understanding the present invention, a description will hereinafter be given, with reference to the accompanying drawings, of the best mode for carrying out the invention.

Embodiment 1

Figure 1:
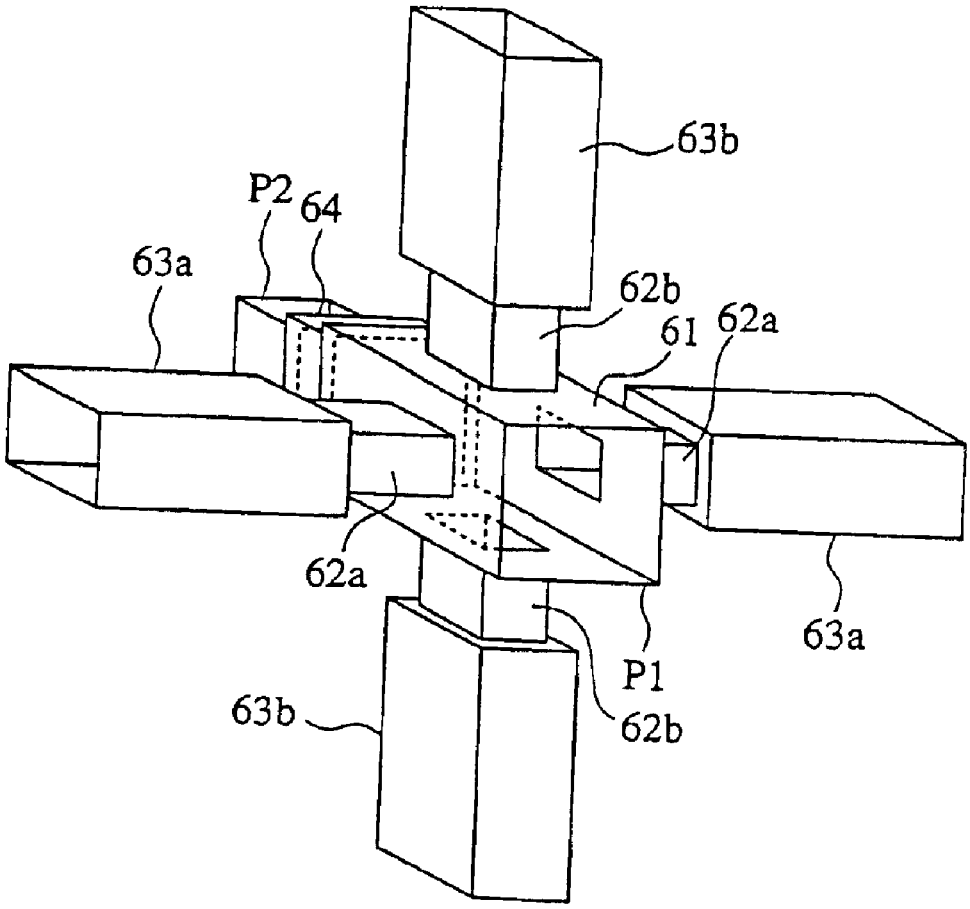
FIG. 1 is a diagrammatic sketch of a conventional waveguide group branching filter.
Figure 2:
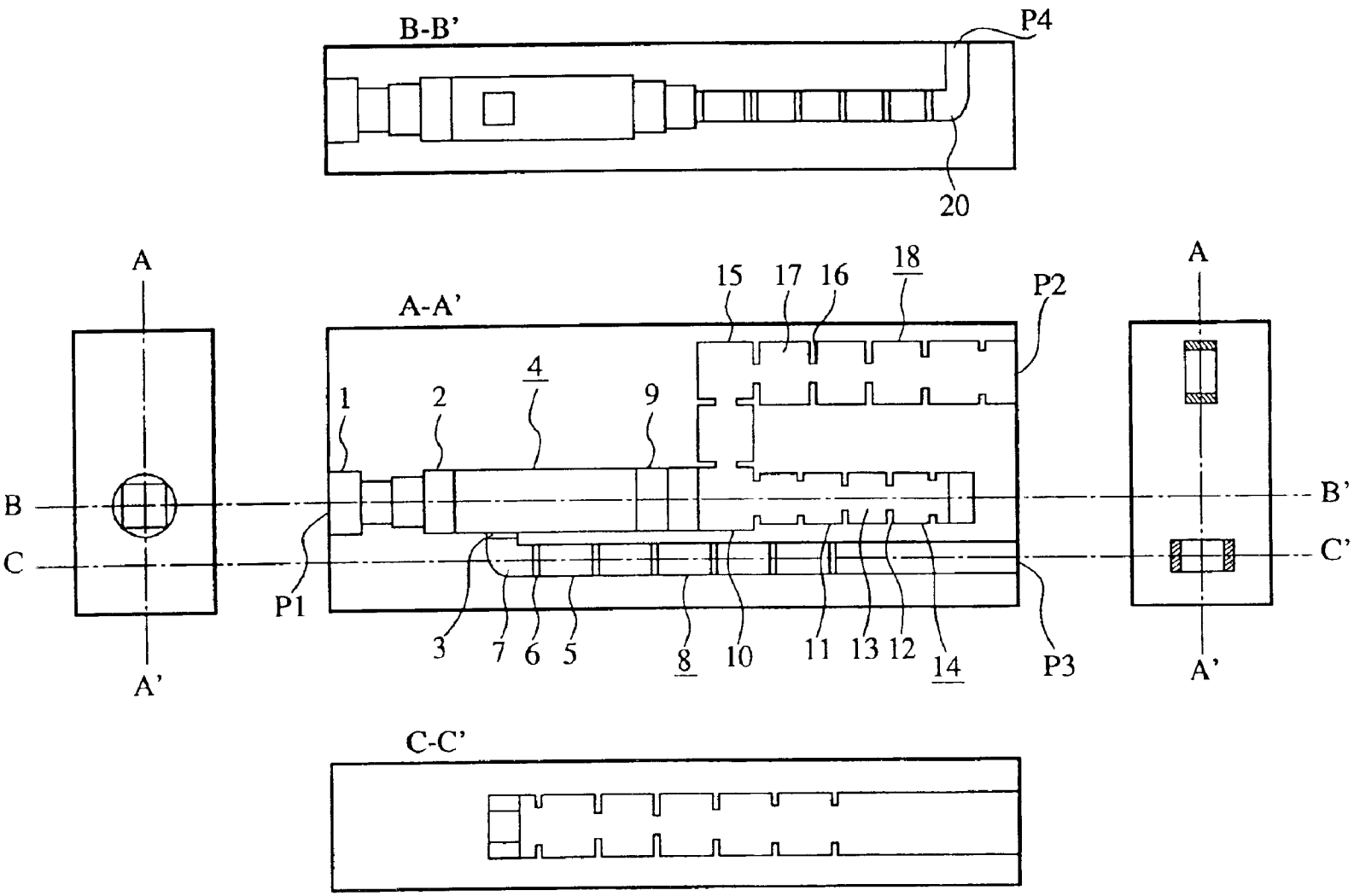
FIG. 2 is a diagrammatic showing of a waveguide group branching filter according to Embodiment 1 of the present invention.

FIG. 2 is a diagrammatic showing of a waveguide group branching filter according to Embodiment 1 of the present invention. In FIG. 2, reference numeral 1 denotes a circular-to-square waveguide multistage transformer; 2 denotes a square waveguide connected to one end of the circular-to-square waveguide multistage transformer 1; 3 denotes a coupling hole formed through one sidewall of the square waveguide 2; 4 denotes a branch waveguide polarizer/branching filter formed by the square waveguide 2 and the coupling hole 3; 5 denotes a rectangular waveguide connected to the branching end of the branch waveguide polarizer/branching filter and having an E-plane bend; 6 denotes n (where n is an integer equal to or greater than 1) iris-type coupling holes provided in the rectangular waveguide 5; 7 denotes n rectangular cavity resonators separated by the coupling hole 3 and the n coupling holes 6 in the rectangular waveguide 5; and 8 denotes generally a waveguide band-pass filter (a first waveguide band-pass filter) made up of the rectangular waveguide 5, the coupling hole 3, the iris-type coupling holes, and the rectangular cavity resonators 7.

In FIG. 2, reference numeral 9 denotes a rectangular waveguide multistage transformer connected to one end of the branch waveguide polarizer/branching filter; 10 denotes a rectangular H-plane T-branch circuit connected to the rectangular waveguide multistage transformer 9; 11 denotes a rectangular waveguide connected to one end of the rectangular waveguide H-plane T-branch circuit 10; 12 denotes m+1 (where m is an integer equal to or greater than 1) iris-type coupling holes provided in the rectangular waveguide 11; 13 denotes m rectangular cavity resonators separated by the m+1 iris-type coupling holes 12 in the rectangular waveguide 11; 14 denotes generally a waveguide band-pass filter (a second waveguide band-pass filter) made up of the rectangular waveguide 11, the iris-type coupling holes 12, and the rectangular cavity resonators 13.

Furthermore, in FIG. 2, reference numeral 15 denotes a rectangular waveguide connected to the branching end of the rectangular H-plane T-branch circuit 10 and having an H-plane corner portion; 16 denotes n+1 iris-type coupling holes provided in the rectangular waveguide 15; 17 denotes n rectangular cavity resonators separated by the n+1 iris-type coupling holes 16 in the rectangular waveguide 15; 18 denotes generally a waveguide band-pass filter (a third waveguide band-pass filter made up of the rectangular waveguide 15, the iris-type coupling holes 16 and the rectangular cavity resonators 17; 20 denotes a rectangular waveguide E-plane bend connected to the waveguide band-pass filter 14; P1 denotes an input port; and P2 and P3 denotes output ports.

Next, the operation of this embodiment will be described below.

Now, assume that a radio wave V1 (a first radio wave) of the polarization plane vertical to the branch plane of the branch waveguide polarizer/branching filter 4 in a certain frequency band f1 (a first frequency band), a radio wave H1 (a second radio wave) of the polarization plane parallel to the branch plane of the branch waveguide polarizer/branching filter 4 in the frequency band f1, and a radio wave V2 (a third rave wave) of the same polarization plane as that of the radio wave in a frequency band f2 (a second frequency band) higher than the frequency band f1, are incident from the input port P1. At this time, the incident radio wave V1 passes through the circular-to-square waveguide multistage transformer 1, by which it is transformed to the fundamental mode of the square waveguide 2, that is, TE10 mode.

The radio wave V1 thus transformed to the TE10 mode does not couple with the coupling hole 3 in the branch waveguide polarizer/branching filter 4 due to the cutoff effect of the waveguide band-pass filter 8, but instead it propagates through the rectangular multistage transformer 9, then forms a standing wave in the rectangular waveguide H-plane T-branch circuit 10 due to the cutoff effect of the waveguide band-pass filter 14, couples with the fundamental mode of the rectangular waveguide 15 via the iris-type coupling holes 16, and passes through the waveguide band-pass filter 18, thereafter being emitted from the output port P2.

Another incident radio wave H1 passes through the circular-to-square waveguide multistage transformer 1, by which it is transformed to the fundamental mode of the square waveguide 2, that is, the TE01 mode. In the branch waveguide polarizer/branching filter 4 the radio wave H1 thus transformed to the TE01 mode undergoes total reflection to form a standing wave due to the cutoff effect of the square waveguide multistage transformer 9, then couples with the fundamental mode of the square waveguide 5 through the coupling hole 3, and passes through the waveguide band-pass filter 8, thereafter being emitted from the output port P3.

Yet another incident radio wave V2 pass through the circular-to-square multistage transformer 1, by which it is transformed to the fundamental mode of the square waveguide 2, that is, the TE10 mode. The radio wave V2 thus transformed to the TE10 mode does not couple with the coupling hole 3 due to the cutoff effect of the waveguide band-pass filter 8, but instead it propagates through the rectangular waveguide multistage transformer 9; and in the rectangular waveguide H-plane T-branch circuit 10, the radio wave does not couple with the iris-type coupling holes 16 due to the cutoff effect of the waveguide band-pass filter 18, but it passes through the waveguide band-pass filter 14 and the rectangular waveguide E-plane bend 20, thereafter being emitted from the output port P4.

By suitably selecting the waveguide diameter of each step and step spacing of each of the circular-to-square multistage transformer 1 and the rectangular waveguide multistage transformer 9 and the size and position of each of the coupling hole and the rectangular waveguide H-plane T-branch circuit 10, reflected waves of the radio waves V1, H1 and V2 incident from the input port P1 can be held small.

As described above, according to Embodiment 1, even if the frequencies of the radio waves V1 (H1) and V2 incident from the input port P1 are widely spaced apart ($f2 \geqq \sqrt{2} \times f1$), the generation of higher mode, which greatly contributes to unnecessary coupling of polarized waves, typified by the TE11 or TM11 mode, is completely suppressed in the square waveguide 2 by the vertical symmetry (symmetry to the A–A' plane in FIG. 2) of each of the circular-to-square waveguide multistage transformer 1, the branch waveguide polarizer/branching filter 4 and the rectangular waveguide multistage transformer 9; therefore, this embodiment permits realization of a high-performance waveguide group branching filter with very excellent reflection and polarized wave isolation characteristics.

Further, according to Embodiment 1, the above-mentioned waveguide group branching filter has a pseudo-planar circuit structure which needs only to be divided into two along the A–A' plane in FIG. 2 so that all the constituent circuits can be formed by boring two metal blocks from their surfaces—this facilitates miniaturization and cost reduction of the waveguide group branching filter.

Embodiment 2

Figure 3:
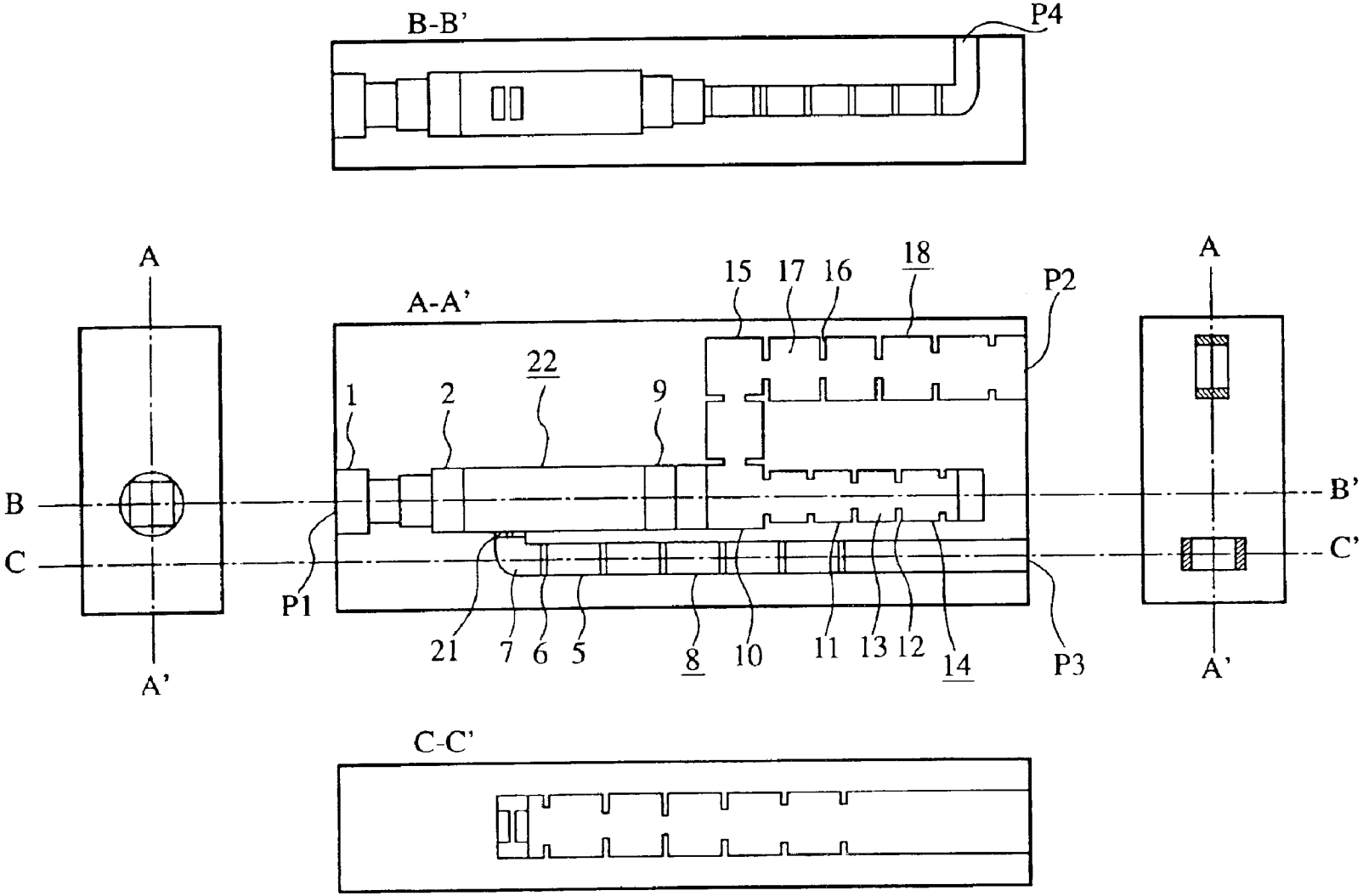
FIG. 3 is a diagrammatic showing of a waveguide group branching filter according to Embodiment 2 of the present invention.

FIG. 3 is a diagrammatic showing of a waveguide group branching filter according to Embodiment 2 of the present invention. In FIG. 3, reference numeral 21 denotes two coupling holes formed through one side wall of the square waveguide 2; and 22 denotes generally a branch waveguide polarizer/branching filter formed by the square waveguide 2 and the two coupling holes 21.

While Embodiment 1 is provided, as depicted in FIG. 2, with the branch waveguide polarizer/branching filter 4 composed of the square waveguide 2 and the single coupling hole 3, Embodiment 2 is provided, as depicted in FIG. 3, with the branch waveguide polarizer/branching filter 22 in place of the branch waveguide polarizer/branching filter 4 shown in FIG. 2; however, this embodiment is identical in construction with Embodiment 1 of FIG. 2 except the above.

The radio waves V1 and V2 incident from the input port P1 do not couple with the two coupling holes 21 in the branch waveguide polarizer/branching filter 22 having the two coupling holes 21 due to increased cutoff effect of the waveguide band-pass filter 8, but instead they propagate in the square waveguide multistage transformer 9.

As described above, Embodiment 2 permits realization of a high-performance waveguide group branching filter that has very excellent reflection and polarized wave isolation characteristics in the square waveguide 2 due to the vertical symmetry of the structures of the circular-to square waveguide multistage transformer 1, the branch waveguide polarizer/branching filter 22 and the rectangular waveguide multistage transformer 9.

Further, according to Embodiment 2, the cutoff effect of the waveguide band-pass filter 8 against the radio waves V1 and V2 in the branch waveguide polarizer/branching filter 22 having the two coupling holes 21 is heightened—this permits realization of a high-performance waveguide group branching filter of more excellent reflection and polarized waves isolation characteristics.

Moreover, according to Embodiment 2, the waveguide group branching filter has a pseudo-planar circuit structure which needs only to be divided into two along the A–A' plane in FIG. 3 so that all the constituent circuits can be formed by boring two metal blocks from their surfaces—this facilitates miniaturization and cost reduction of the waveguide group branching filter.

Embodiment 3

Figure 4:
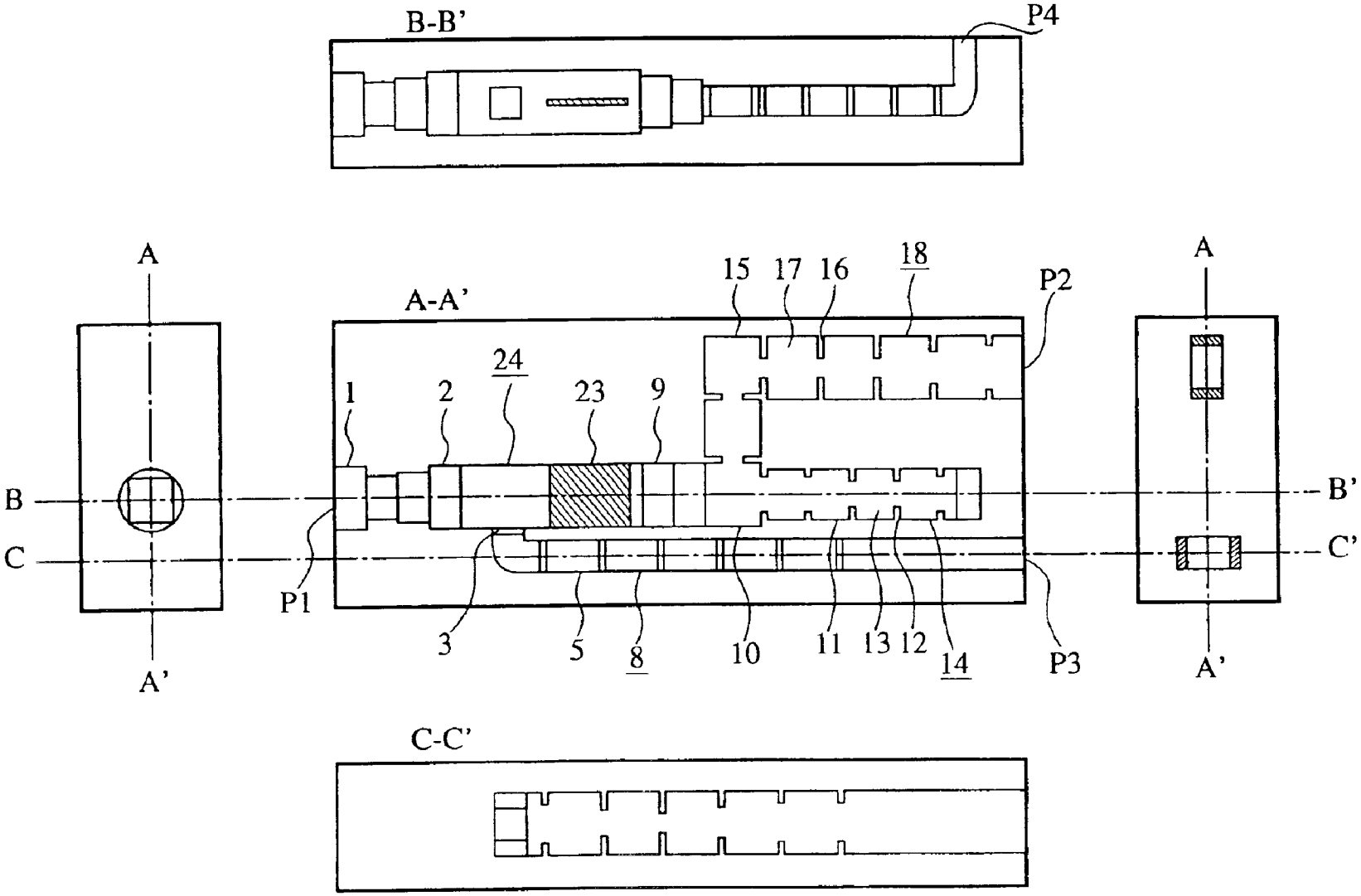
FIG. 4 is a diagrammatic showing of a waveguide group branching filter according to Embodiment 3 of the present invention.

FIG. 4 is a diagrammatic showing of a waveguide group branching filter according to Embodiment 3 of the present invention. In FIG. 4, reference numeral 23 denotes a thin metal sheet inserted in the square waveguide 2; and 24 denotes generally a branch waveguide polarizer/branching filter made up of the square waveguide 2, the single coupling hole 3 and the thin metal sheet 23.

While Embodiment 1 is provided, as depicted in FIG. 2, with the branch waveguide polarizer/branching filter 4 composed of the square waveguide 2 and the single coupling hole 3, Embodiment 3 is provided, as depicted in FIG. 4, with the branch waveguide polarizer/branching filter 24 in place of the branch waveguide polarizer/branching filter 4 shown in FIG. 2; however, this embodiment is identical in construction with Embodiment 1 of FIG. 2 except the above.

The radio wave H1 incident from the input port P1 forms a standing wave due to the cutoff effect by the thin metal sheet 23, then couples with the fundamental mode of the square waveguide 5 through the coupling hole 3, and propagates through the waveguide band-pass filer 8, thereafter being emitted from the output port P3. The frequency characteristic by the cutoff effect of the thin metal sheet 23 is more stable than the frequency characteristic by the cutoff effect of the square waveguide multistage transformer 9—this provides excellent reflection and polarized waves isolation characteristics over a wider band.

As described above, Embodiment 3 permits realization of a high-performance waveguide group branching filter that has very excellent reflection and polarized wave isolation characteristics in the square waveguide 2 due to the vertical symmetry of the structures of the circular-to square waveguide multistage transformer 1, the branch waveguide polarizer/branching filter 24 and the rectangular waveguide multistage transformer 9.

Further, Embodiment 3 permits realization of a high-performance waveguide group branching filter with excellent reflection and polarized waves isolation characteristics over a wider band since the frequency characteristic by the cutoff effect of the thin metal sheet 23 for the radio wave H1 is stable.

Moreover, according to Embodiment 3, the waveguide group branching filter has a pseudo-planar circuit structure which needs only to be divided into two along the A–A' plane in FIG. 4 so that all the constituent circuits, except the thin metal sheet 23, can be formed by boring two metal blocks from their surfaces—this facilitates miniaturization and cost reduction of the waveguide group branching filter.

Embodiment 4

Figure 5:
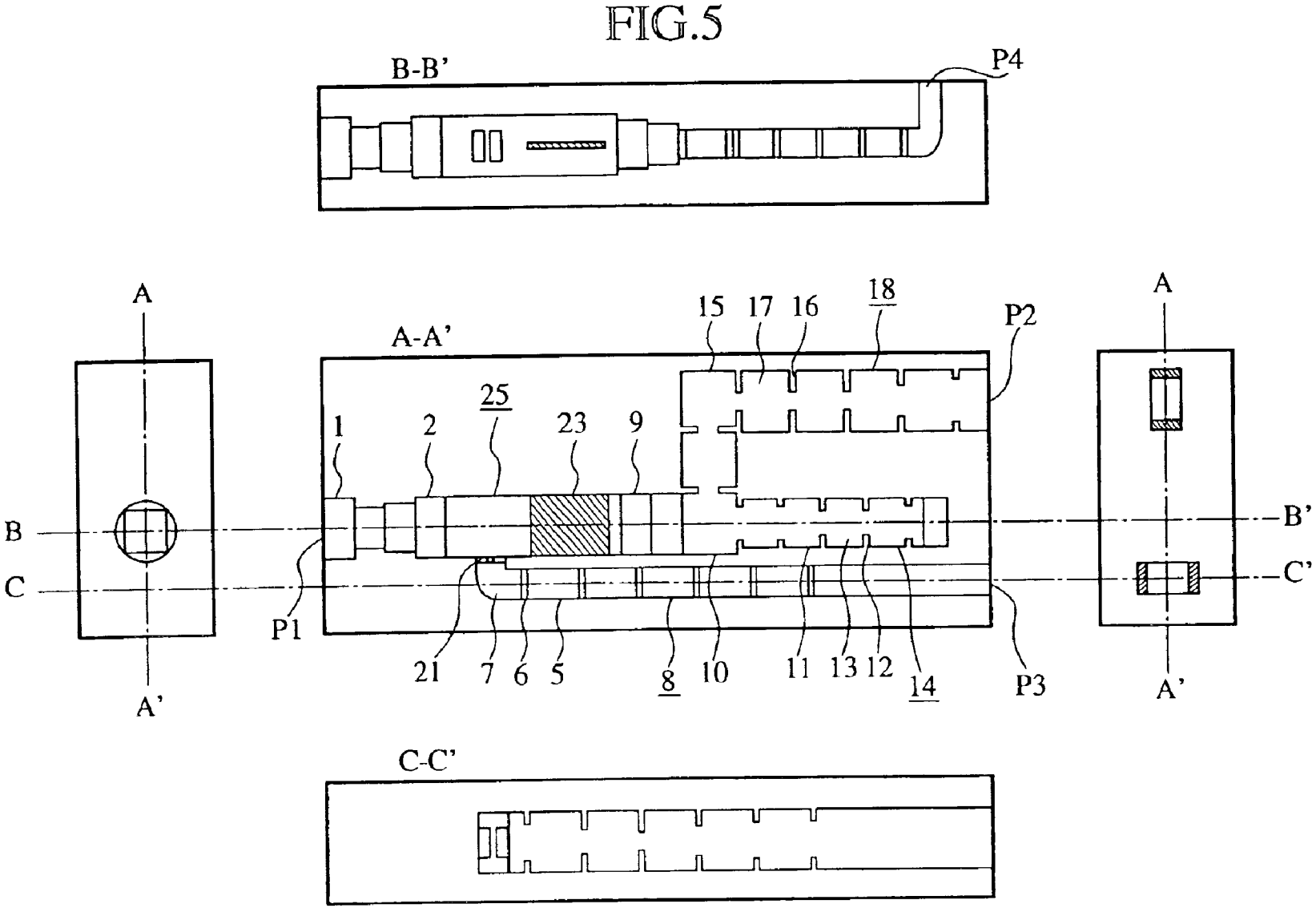
FIG. 5 is a diagrammatic showing of a waveguide group branching filter according to Embodiment 4 of the present invention.

FIG. 5 is a diagrammatic showing of a waveguide group branching filter according to Embodiment 4 of the present invention. In FIG. 5, reference numeral 25 denotes generally a branch waveguide polarizer/branching filter made up of the square waveguide 2, the two coupling holes 3 formed side by side through one side wall of the square waveguide 2 and the thin metal sheet 23 inserted in the square waveguide 2.

While Embodiment 1 is provided, as depicted in FIG. 2, with the branch waveguide polarizer/branching filter 4 composed of the square waveguide 2 and the single coupling hole 3, Embodiment 4 is provided, as depicted in FIG. 5, with the branch waveguide polarizer/branching filter 25 in place of the branch waveguide polarizer/branching filter 4 shown in FIG. 2; however, this embodiment is identical in construction with Embodiment 1 of FIG. 2 except the above.

The radio waves V1 and V2 incident from the input port P1 do not couple with the two coupling holes 21 in the branch waveguide polarizer/branching filter 25 having the two coupling holes 21 due to increased cutoff effect of the waveguide band-pass filter 8, but instead they propagate in the square waveguide multistage transformer 9.

The radio wave H1 incident from the input port P1 forms a standing wave due to the cutoff effect by the thin metal sheet 23, then couples with the fundamental mode of the square waveguide 5 through the coupling hole 3, and propagates through the waveguide band-pass filer 8, thereafter being emitted from the output port P3. The frequency characteristic by the cutoff effect of the thin metal sheet 23 is more stable than the frequency characteristic by the cutoff effect of the square waveguide multistage transformer 9—this provides excellent reflection and polarized waves isolation characteristics over a wider band.

As described above, Embodiment 4 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Further, according to Embodiment 4, since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Moreover, according to Embodiment 4, the waveguide group branching filter has a pseudo-planar circuit structure which needs only to be divided into two along the A–A' plane in FIG. 5 so that all the constituent circuits, except the thin metal sheet 23, can be formed by boring two metal blocks from their surfaces—this facilitates miniaturization and cost reduction of the waveguide group branching filter.

Embodiment 5

Figure 6:
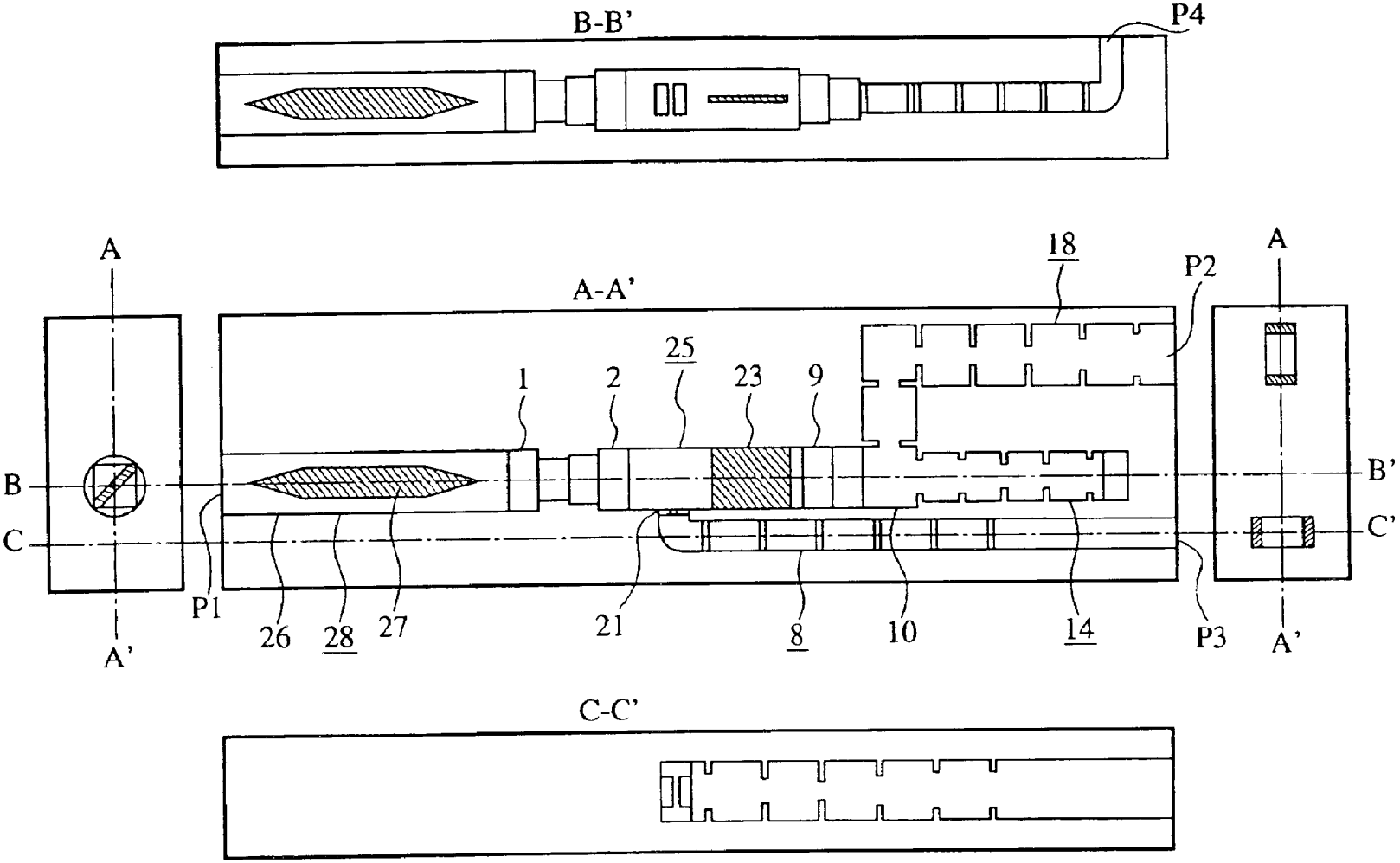
FIG. 6 is a diagrammatic showing of a waveguide group branching filter according to Embodiment 5 of the present invention.

FIG. 6 is a diagrammatic showing of a waveguide group branching filter according to Embodiment 5 of the present invention. In FIG. 6, reference numeral 26 denotes a circular waveguide; 27 denotes a dielectric sheet inserted in the circular waveguide 26; and 28 denotes generally a circularly polarized wave generator composed of the circular waveguide 26 and the dielectric sheet 27 and connected to the circular-to-square waveguide multistage transformer 1.

While Embodiment 4 has been described to be adapted for vertical and horizontal polarization of the radio waves V1 and V2 incident from the input port P1 are vertically and horizontally polarized, Embodiment 5 adds the circularly polarized wave generator 28, as depicted in FIG. 6, to the FIG. 5 waveguide group branching filter of Embodiment 4 by which the radio waves V1, V2 and H1 incident from the input port P1 are rendered to right- and left-handed polarized waves.

In this embodiment the circularly polarized wave generator 28 is added to the waveguide group branching filter of Embodiment 4, but the circularly polarized wave generator 28 may be added as well to the waveguide group branching filters of Embodiments 1 to 3.

As described above, according to Embodiment 5, the circularly polarized wave generator 28 is provided for the generation of right- and left-handed polarized waves from the radio waves V1, V2 and H1.

Further, Embodiment 5 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Furthermore, according to Embodiment 5, since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Moreover, according to Embodiment 5, the waveguide group branching filter has a pseudo-planar circuit structure which needs only to be divided into two along the A–A' plane in FIG. 6 so that all the constituent circuits, except the thin metal sheet 23, can be formed by boring two metal blocks from their surfaces—this facilitates miniaturization and cost reduction of the waveguide group branching filter.

Embodiment 6

Figure 7:
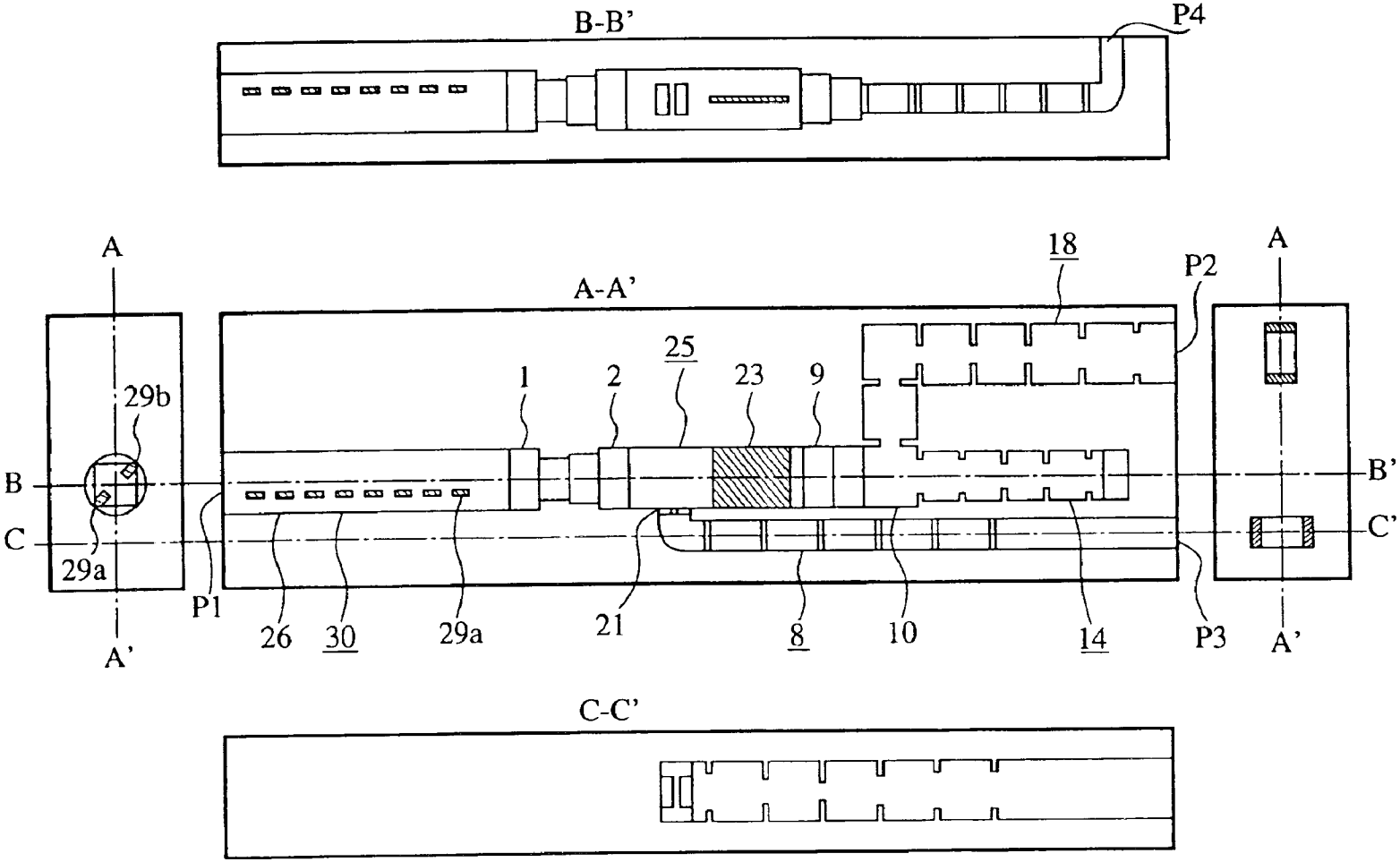
FIG. 7 is a diagrammatic showing of a waveguide group branching filter according to Embodiment 6 of the present invention.

FIG. 7 is a diagrammatic showing of a waveguide group branching filter according to Embodiment 6 of the present invention. In FIG. 7, reference numeral 29*a* denotes a plurality of metal pins mounted on the inner wall of the circular waveguide 26 in its axial direction; 29*b* denotes a plurality of metal pins diagonally opposite the metal pins 29*a* with regard to the longitudinal axis of the circular waveguide 26; and 30 denotes generally a circularly polarized wave generator made up of the circular waveguide 26 and the metal pins 29*a* and 29*b*.

While Embodiment 5 is provided, as depicted in FIG. 6, with the circularly polarized wave generator 28 made up of the circular waveguide 26 and the dielectric sheet 27, Embodiment 6 is provided, as depicted in FIG. 7, with the circularly polarized wave generator 30 in place of the circularly polarized wave generator 28 shown in FIG. 6; however, this embodiment is identical in construction with Embodiment 1 of FIG. 2 except the above. With the provision of the circularly polarized wave generator 30, this embodiment can be adapted to generate right- and left-handed polarized waves from the radio waves V1, V2 and H1 incident from the input port P1.

In this embodiment the circularly polarized wave generator 30 is added to the waveguide group branching filter of Embodiment 4, but the circularly polarized wave generator 30 may be added as well to the waveguide group branching filters of Embodiments 1 to 3.

As described above, according to Embodiment 6, the circularly polarized wave generator 30 provides for the generation of right- and left-handed polarized waves from the radio waves V1, V2 and H1.

Further, Embodiment 6 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Furthermore, according to Embodiment 6, since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Moreover, according to Embodiment 6, the waveguide group branching filter has a pseudo-planar circuit structure which needs only to be divided into two along the A–A' plane in FIG. 7 so that all the constituent circuits, except the tin metal sheet 23, can be formed by boring two metal blocks from their surfaces—this facilitates miniaturization and cost reduction of the waveguide group branching filter.

Embodiment 7

Figure 8:
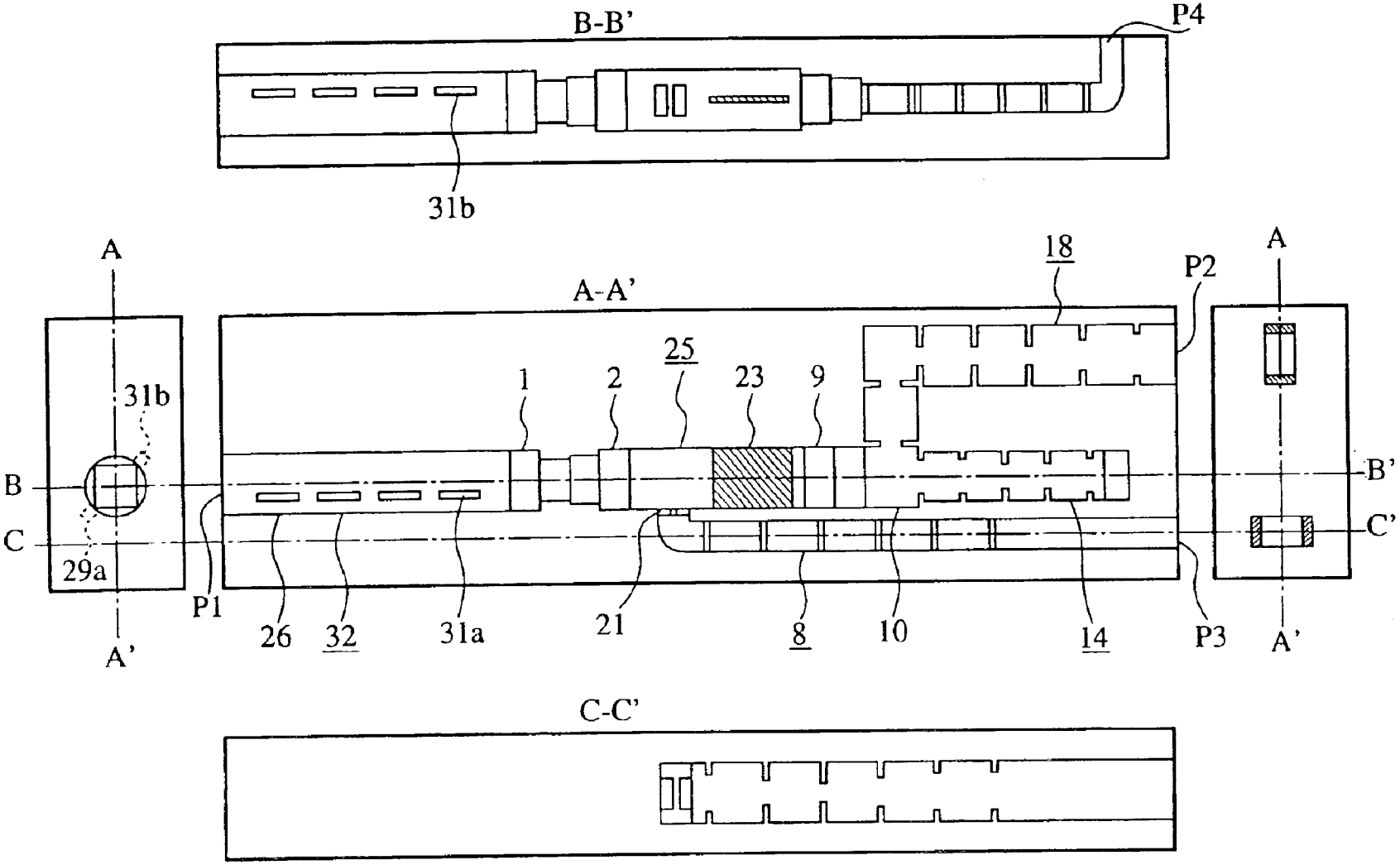
FIG. 8 is a diagrammatic showing of a waveguide group branching filter according to Embodiment 7 of the present invention.

FIG. 8 is a diagrammatic showing of a waveguide group branching filter according to Embodiment 7 of the present invention. In FIG. 8, reference numeral 31*a* denotes a plurality of grooves cut in the side wall of the circular waveguide 26 along its axial direction; 31*b* denotes a plurality of grooves diagonally opposite the grooves 31*a* with regard to the longitudinal axis of the circular waveguide 26; and 32 denotes generally a circularly polarized wave generator made up of the circular waveguide 26 and the grooves 31*a* and 31*b*.

While Embodiment 5 is provided, as depicted in FIG. 6, with the circularly polarized wave generator 28 made up of the circular wave guide 26 and the dielectric sheet 27, Embodiment 7 is provided, as depicted in FIG. 8, with the circularly polarized wave generator 32 in place of the circularly polarized wave generator 28 shown in FIG. 6; the circularly polarized wave generator 32 provides for the generation of right- and left-handed polarized waves from the radio waves V1, V2 and H1 incident from the input port P1.

In this embodiment the circularly polarized wave generator 32 is added to the waveguide group branching filter of Embodiment 4, but the circularly polarized wave generator 32 may be added as well to the waveguide group branching filters of Embodiments 1 to 3.

As described above, according to Embodiment 7, the circularly polarized wave generator 32 provides for the generation of right- and left-handed polarized waves from the radio waves V1, V2 and H1.

Further, Embodiment 7 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Furthermore, according to Embodiment 7, since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Moreover, according to Embodiment 7, the waveguide group branching filter has a pseudo-planar circuit structure which needs only to be divided into two along the A–A' plane in FIG. 8 so that all the constituent circuits, except the thin metal sheet 23, can be formed by boring two metal blocks from their surfaces—this facilitates miniaturization and cost reduction of the waveguide group branching filter.

Embodiment 8

Figure 9:
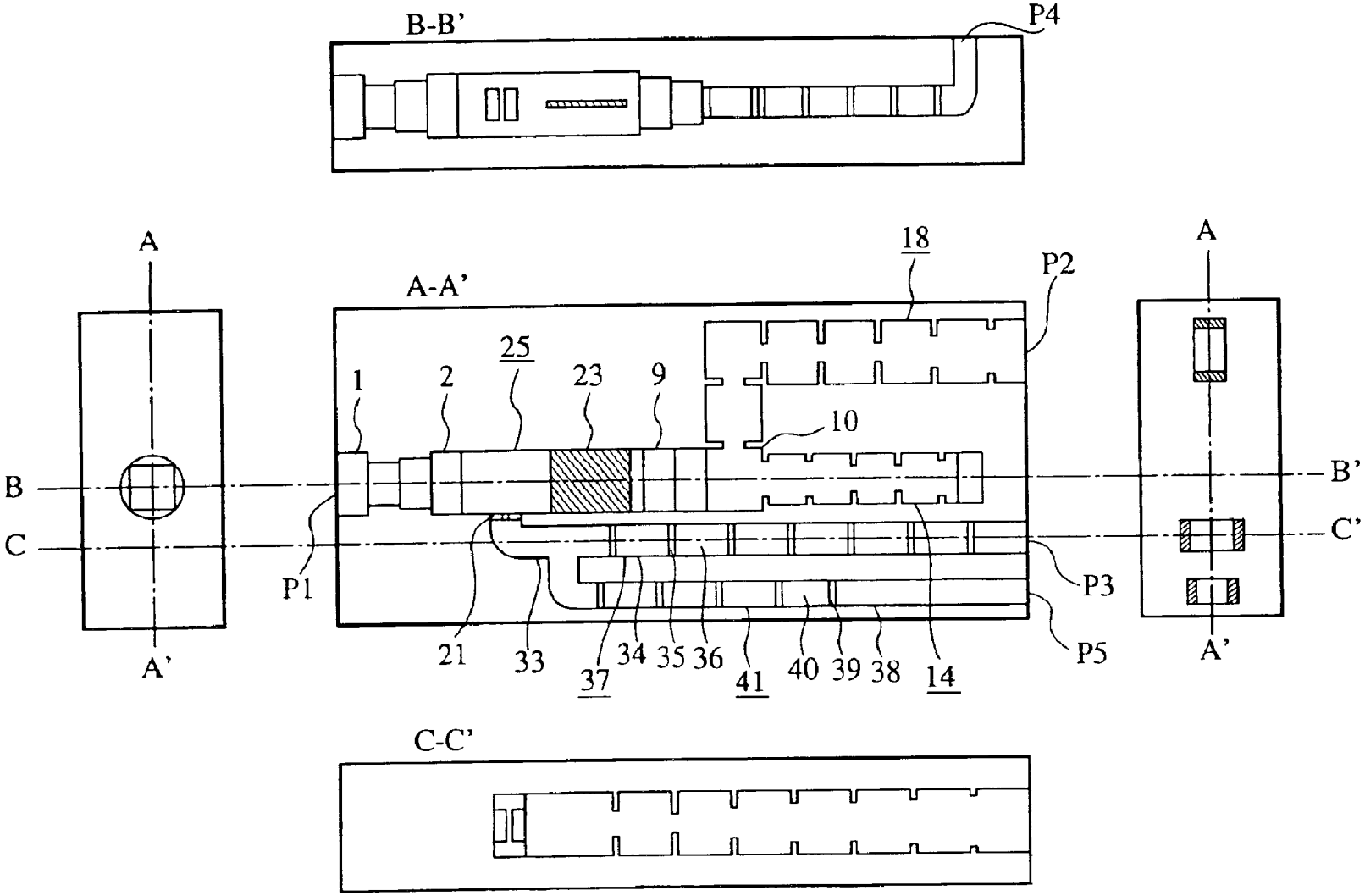
FIG. 9 is a diagrammatic showing of a waveguide group branching filter according to Embodiment 8 of the present invention.

FIG. 9 is a diagrammatic showing of a waveguide group branching filter according to Embodiment 8 of the present invention. In FIG. 9, reference numeral 33 denotes a rectangular waveguide E-plane T-branch circuit connected to the branching end of the branch waveguide polarizer/branching filter 25; 34 denotes a rectangular waveguide connected to the branching end of the rectangular waveguide E-plane T-branch circuit 33; 35 denotes n+1 iris-type coupling holes mounted in the rectangular waveguide 34; 36 denotes n rectangular cavity resonators separated by the n+1 iris-type coupling holes 35 in the rectangular waveguide 34; and 37 denotes generally a waveguide band-pass filter (a first waveguide band-pass filter) made up of the rectangular waveguide 34, the n+1 iris-type coupling holes 35 and the n rectangular cavity resonators 36.

Further, in FIG. 9, reference numeral 38 denotes a rectangular waveguide connected to one end of the rectangular waveguide E-plane t-branch circuit 33; 39 denotes m+1 iris-type coupling holes mounted in the rectangular waveguide 38; 40 denotes m rectangular cavity resonators separated by the m+1 iris-type coupling holes 39 in the rectangular waveguide 38; 41 denotes generally a waveguide band-pass filter (a fourth waveguide band-pass filter) made up of the rectangular waveguide 38, the m+1 iris-type coupling holes 39 and the m rectangular cavity resonators 40; and P5 denotes an output port. This embodiment is identical in construction with Embodiment 4 except the above.

While Embodiment 4 has been described to be capable of group branching of the three kinds of radio waves V1, V2 and H1 incident from the input port P1, Embodiment 8 is provided, as depicted in FIG. 9, with the rectangular waveguide E-plane T-branch circuit 33, the waveguide band-pass filter 37 and the waveguide band-pass filter 41 in place of the waveguide band-pass filter 8 shown in FIG. 5.

With such a structure as mentioned above, the radio wave V1 of the frequency band f1 incident from the input port P1, which has its polarization plane vertical to the branching plane of the branch waveguide polarizer/branching filter 25, is emitted from the output port P2, and the radio wave H1 of the frequency band f1, which has its polarization plane horizontal to the branching plane of the branch waveguide polarizer/branching filter 25, is emitted from the output port P3. The radio wave V2 of the frequency band f2 higher than the frequency band f1, which has the same polarization plane as that of the radio wave V1 is emitted from the output port P4, and the radio wave H2 of the frequency band f2, which has its polarization plane horizontal to the branching plane of the branch waveguide polarizer/branching filter 25, is emitted from the output port P5. In this way, the waveguide group branching filter according to Embodiment 8 is able to perform group branching of a total of four kinds of radio waves.

While this embodiment modifies the waveguide group branching filter of Embodiment 4 to perform group branching of the four kinds of radio wave, the waveguide group branching filters of Embodiment 1 to 3 and 5 to 7 may also be modified for group branching of the four kinds f radio waves.

As described above, Embodiment 8 is applicable to the case where the radio wave incident thereto or emitted therefrom are two orthogonal polarized waves in each of two frequency bands; hence, this embodiment produces the effect of group branching of the four kinds of radio waves.

Further, Embodiment 8 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Furthermore, according to Embodiment 8, since the cutoff effect of the waveguide band-pass filter 8 against the radio waves V1 and V2 in the branch waveguide polarizer/branching filter 25 having the two coupling holes 21 is heightened and since the frequency characteristics by the cutoff effect of the thin metal sheet 23 for the radio waves H1 and H2 are stable, this embodiment permits realization of a high-performance waveguide group branching filter with excellent reflection and polarized waves isolation characteristics in a wider band.

Moreover, according to Embodiment 8, the waveguide group branching filter has a pseudo-planar circuit structure which needs only to be divided into two along the A–A' plane in FIG. 9 so that all the constituent circuits, except the thin metal sheet 23, can be formed by boring two metal blocks from their surfaces—this facilitates miniaturization and cost reduction of the waveguide group branching filter.

Embodiment 9

Figure 10:
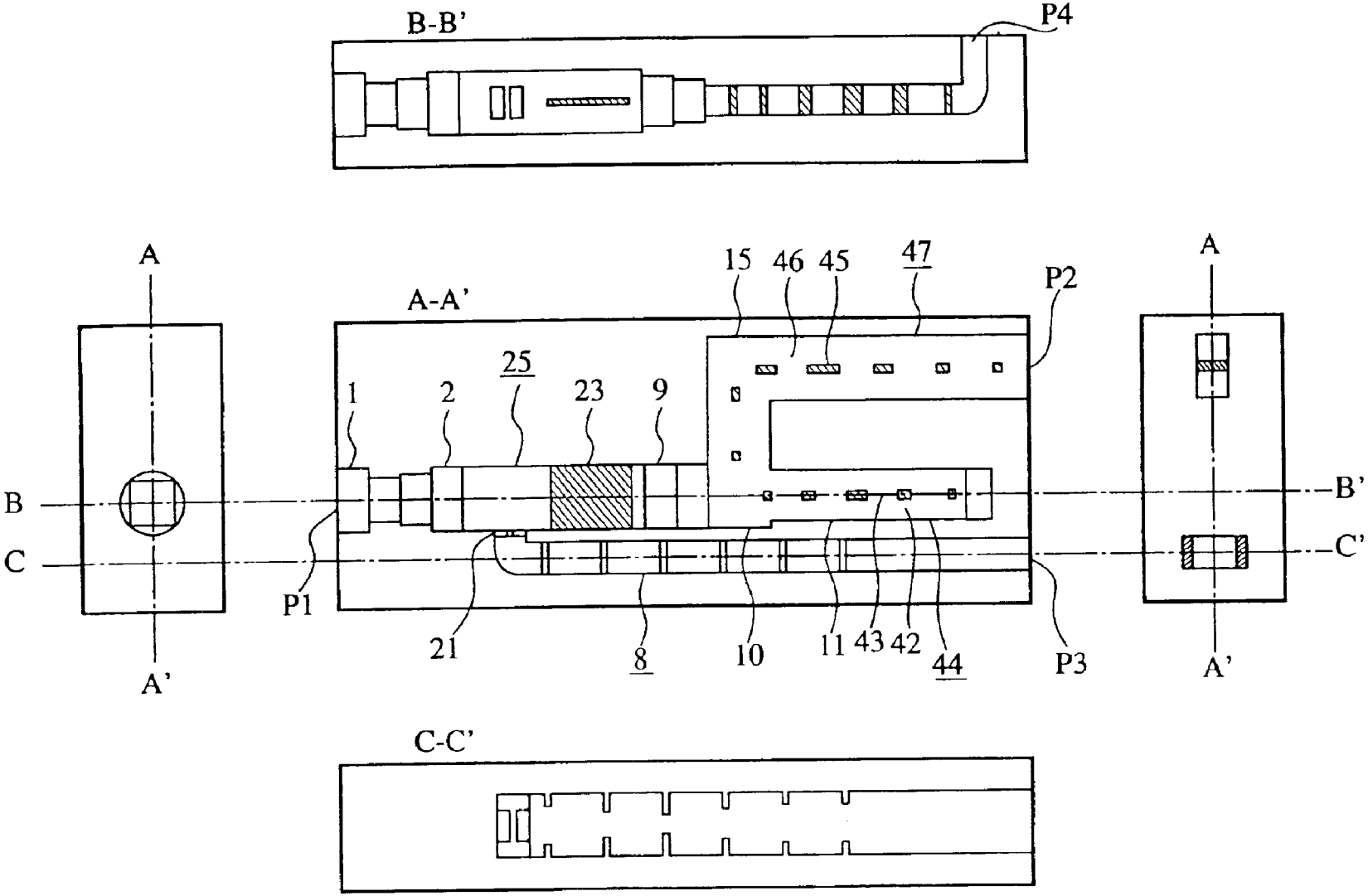
FIG. 10 is a diagrammatic showing of a waveguide group branching filter according to Embodiment 9 of the present invention.

FIG. 10 is a diagrammatic showing of a waveguide group branching filter according to Embodiment 9 of the present invention. In FIG. 10, reference numeral 42 denotes 2m+2 post-type coupling holes mounted in the rectangular waveguide 11; 43 denotes m rectangular cavity resonators separated by the 2m+2 post-type coupling holes 42 in the rectangular waveguide 11; and 44 denotes generally a waveguide band-pass filter made up of the rectangular waveguide 11, the 2m+2 post-type coupling holes 42 and the m rectangular cavity resonators 43.

Further, in FIG. 10, reference numeral 45 denotes 2n+2 post-type coupling holes mounted in the rectangular waveguide 15; 46 denotes n rectangular cavity resonators separated by the 2n+2 post-type coupling holes 45 in the rectangular waveguide 15; and 47 denotes generally a waveguide band-pass filter made up of the rectangular waveguide 15, the 2n+2 post-type coupling holes 45 and the n rectangular cavity resonators 46.

While Embodiment 4 is provided, as depicted in FIG. 5, with the waveguide band-pass filter 14 comprised of the rectangular waveguide 11, the m+1 iris-type coupling holes 12 and the m rectangular cavity resonators 13 and the waveguide band-pass filter 18 comprised of the rectangular waveguide 15, the n+1 iris-type coupling holes 16 and the n rectangular cavity resonator 17, Embodiment 9 is provided, as depicted in FIG. 10, with the waveguide band-pass filters 44 and 47 in place of the waveguide band-pass filters 14 and 18 shown in FIG. 5; this embodiment is identical in construction with Embodiment 4 of FIG. 5 except the above.

Figure 11:
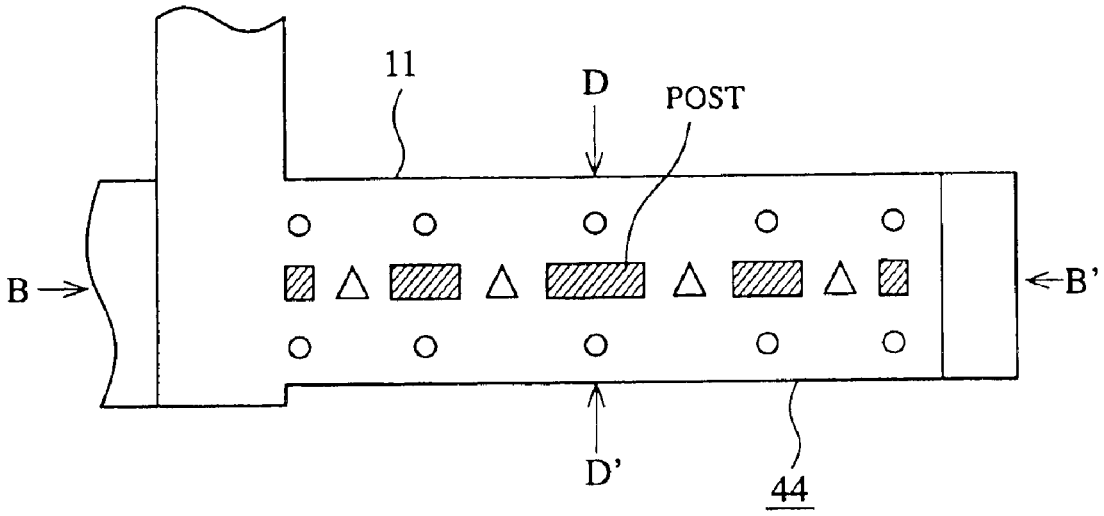
FIG. 11 is a diagram showing the relationship between post-type coupling holes and rectangular cavity resonators in a waveguide band-pass filter according to Embodiment 9 of the present invention.
Figure 11:
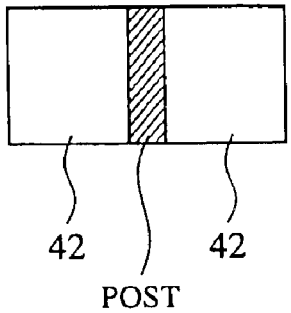

FIG. 11 is a diagram showing the relationship between the post-type coupling holes 42 and the rectangular cavity resonators 43 in the waveguide band-pass filter 44. As shown, the post-type coupling holes 42 are formed by posts made in the rectangular waveguide 11. Generally, when the number of post-type coupling holes 42 is 2m+2, the number of the rectangular cavity resonators 43 is m; FIG. 11 shows the case where m=4. The same goes for the waveguide band-pass filter 47.

While this embodiment uses the waveguide band-pass filters 44 and 47 as substitutes for those 14 and 18 in Embodiment 4, the waveguide band-pass filters 15 and 18 in Embodiments 1 to 3 and 5 to 8 may also be substituted with the waveguide band-pass filters 44 and 47.

As described above, according to Embodiment 9, in the formation of all the constituent circuits, except the thin metal sheet 23, divided into two parts along the A–A' plane in FIG. 10 by boring two metal blocks from their surfaces, the waveguide band-pass filters 44 and 47 are free from curved portions unavoidable in boring a metal working—this provides increased design accuracy.

Further, according to Embodiment 9, since the posts are disposed in the central portions of the rectangular waveguides 11 and 15 where the field intensity is high, the attenuation characteristic in the lower frequency side of the pass band can be made steeper without increasing the numbers of the rectangular cavity resonators 43 and 46.

Furthermore, Embodiment 9 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Moreover, according to Embodiment 9, since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Besides, according to Embodiment 9, the waveguide group branching filter has a pseudo-planar circuit structure which needs only to be divided into two along the A–A' plane in FIG. 10 so that all the constituent circuits, except the thin metal sheet 23, can be formed by boring two metal blocks from their surfaces—this facilitates miniaturization and cost reduction of the waveguide group branching filter.

Embodiment 10

Figure 12:
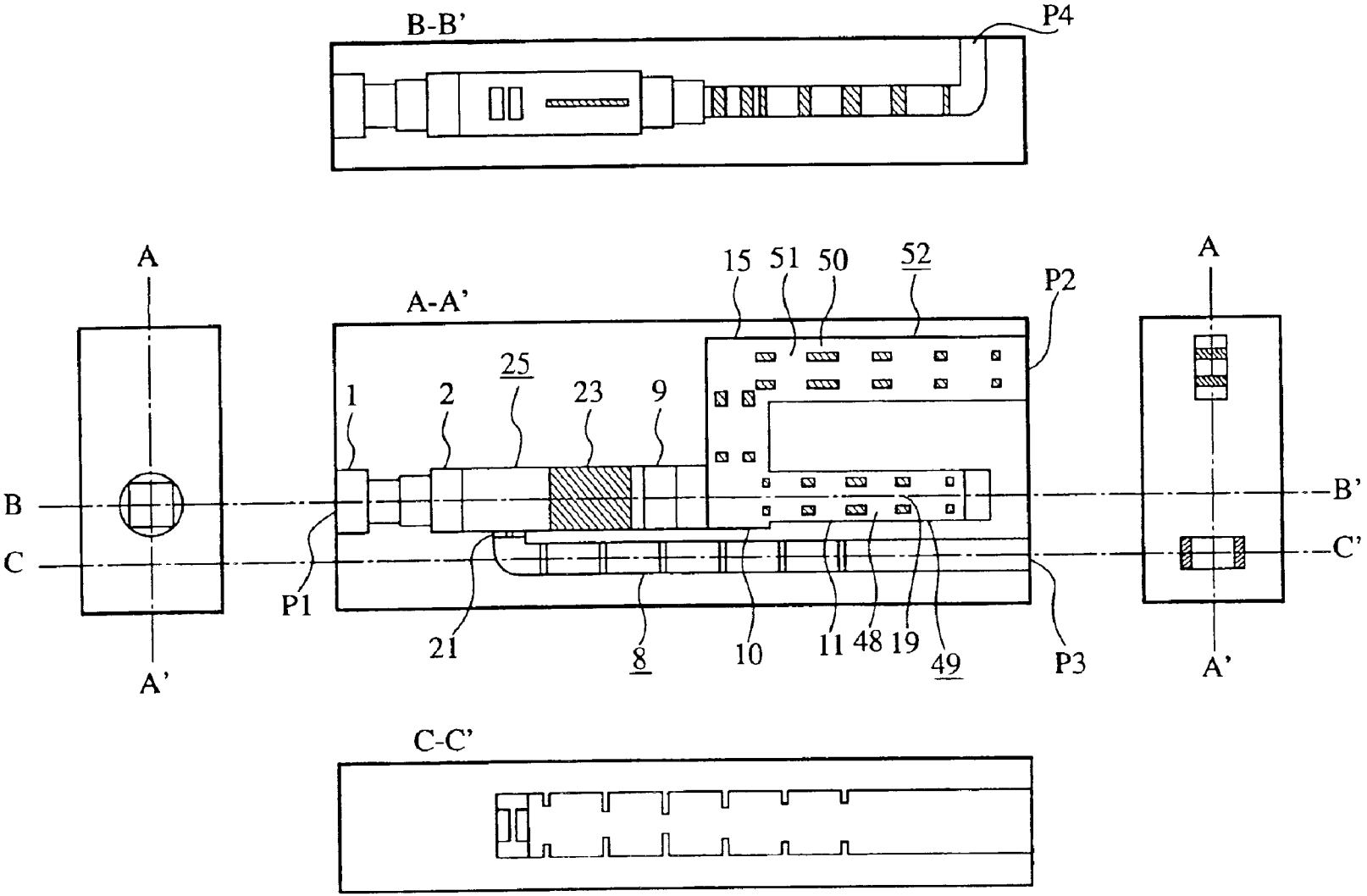
FIG. 12 is a diagrammatic showing of a waveguide group branching filter according to Embodiment 10 of the present invention.

FIG. 12 is a diagrammatic showing of a waveguide group branching filter according to Embodiment 10 of the present invention. In FIG. 12, reference numeral 19 denotes a total of 3m+3 double-post-type coupling holes mounted in the rectangular waveguide 11; 48 denotes m rectangular cavity resonators separated by the 3m+3 double-post-type coupling holes 19 in the rectangular waveguide 11; and 49 denotes generally a waveguide band-pass filter made up of the rectangular waveguide 11, the 3m+3 double-post-type coupling holes 19 and the m rectangular cavity resonators 48.

Further, in FIG. 12, reference numeral 50 denotes a total of 3n+3 double-post-type coupling holes mounted in the rectangular waveguide 15; 51 denotes n rectangular cavity resonators separated by the 3n+3 double-post-type coupling holes 50 in the rectangular waveguide 15; and 52 denotes generally a waveguide band-pass filter made up of the rectangular waveguide 15, the 3n+3 double-post-type coupling holes 50 and the n rectangular cavity resonators 51.

While Embodiment 4 is provided, as depicted in FIG. 5, with the waveguide band-pass filter 14 comprised of the rectangular waveguide 11, the m+1 iris-type coupling holes 12 and the m rectangular cavity resonators 13 and the waveguide band-pass filter 18 comprised of the rectangular waveguide 15, the n+1 iris-type coupling holes 16 and the n rectangular cavity resonator 17, Embodiment 10 is provided, as depicted in FIG. 12, with the waveguide band-pass filters 49 and 52 in place of the waveguide band-pass filters 14 and 18 shown in FIG. 5; this embodiment is identical in construction with Embodiment 4 of FIG. 5 except the above.

Figure 13:
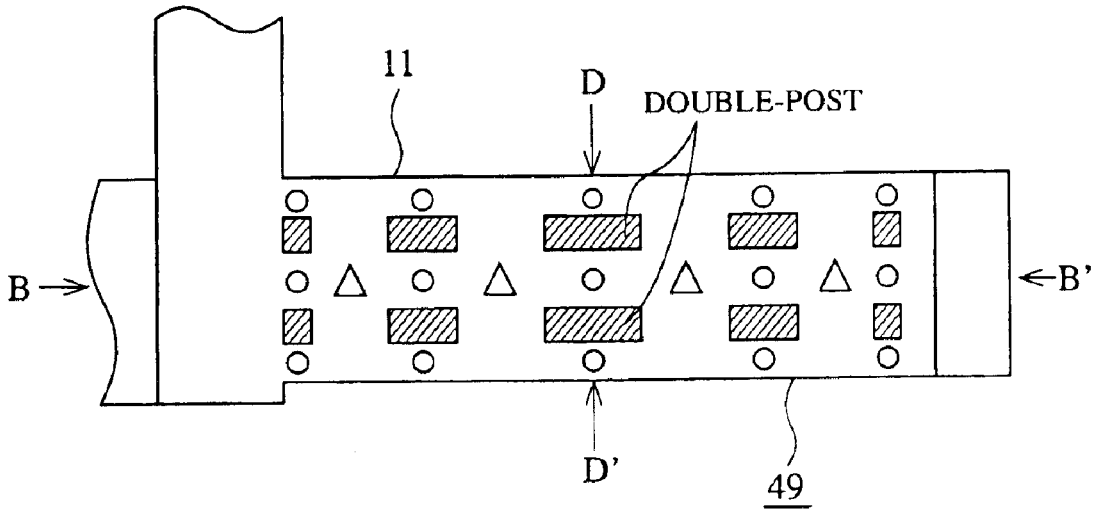
FIG. 13 is a diagram showing the relationship between double-post-type coupling holes and rectangular cavity resonators in a waveguide band-pass filter according to Embodiment 10 of the present invention.
Figure 13:
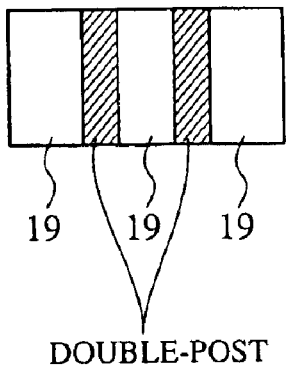

FIG. 13 is a diagram showing the relationship between the double-post-type coupling holes 19 and the rectangular cavity resonators 48 in the waveguide band-pass filter 49. As shown, the double-post-type coupling holes 19 are formed by double-posts made in the rectangular waveguide 11. Generally, when the number of double-post-type coupling holes 19 is 3m+3, the number of the rectangular cavity resonators 48 is m; FIG. 13 shows the case where m=4. The same goes for the waveguide band-pass filter 52.

While this embodiment uses the waveguide band-pass filters 49 and 52 as substitutes for those 14 and 18 in Embodiment 4, the waveguide band-pass filters 15 and 18 in Embodiments 1 to 3 and 5 to 8 may also be substituted with the waveguide band-pass filters 49 and 52.

As described above, according to Embodiment 10, in the formation of all the constituent circuits, except the thin metal sheet 23, divided into two parts along the A–A' plane in FIG. 11 by boring two metal blocks from their surfaces, the waveguide band-pass filters 49 and 52 are free from curved portions unavoidable in boring a metal working—this provides increased design accuracy.

Further, according to Embodiment 10, since the double-post-type coupling holes 19 can be positioned in the central portions of the rectangular wave guides 11 and 15 where the field intensity is high, the diameters of the double-posts can be made relatively large, allowing ease in fabrication.

Furthermore, Embodiment 10 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Moreover, according to Embodiment 10, since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Besides, according to Embodiment 10, the waveguide group branching filter has a pseudo-planar circuit structure which needs only to be divided into two along the A–A' plane in FIG. 12 so that all the constituent circuits, except the thin metal sheet 23, can be formed by boring two metal blocks from their surfaces—this facilitates miniaturization and cost reduction of the waveguide group branching filter.

Embodiment 11

Figure 14:
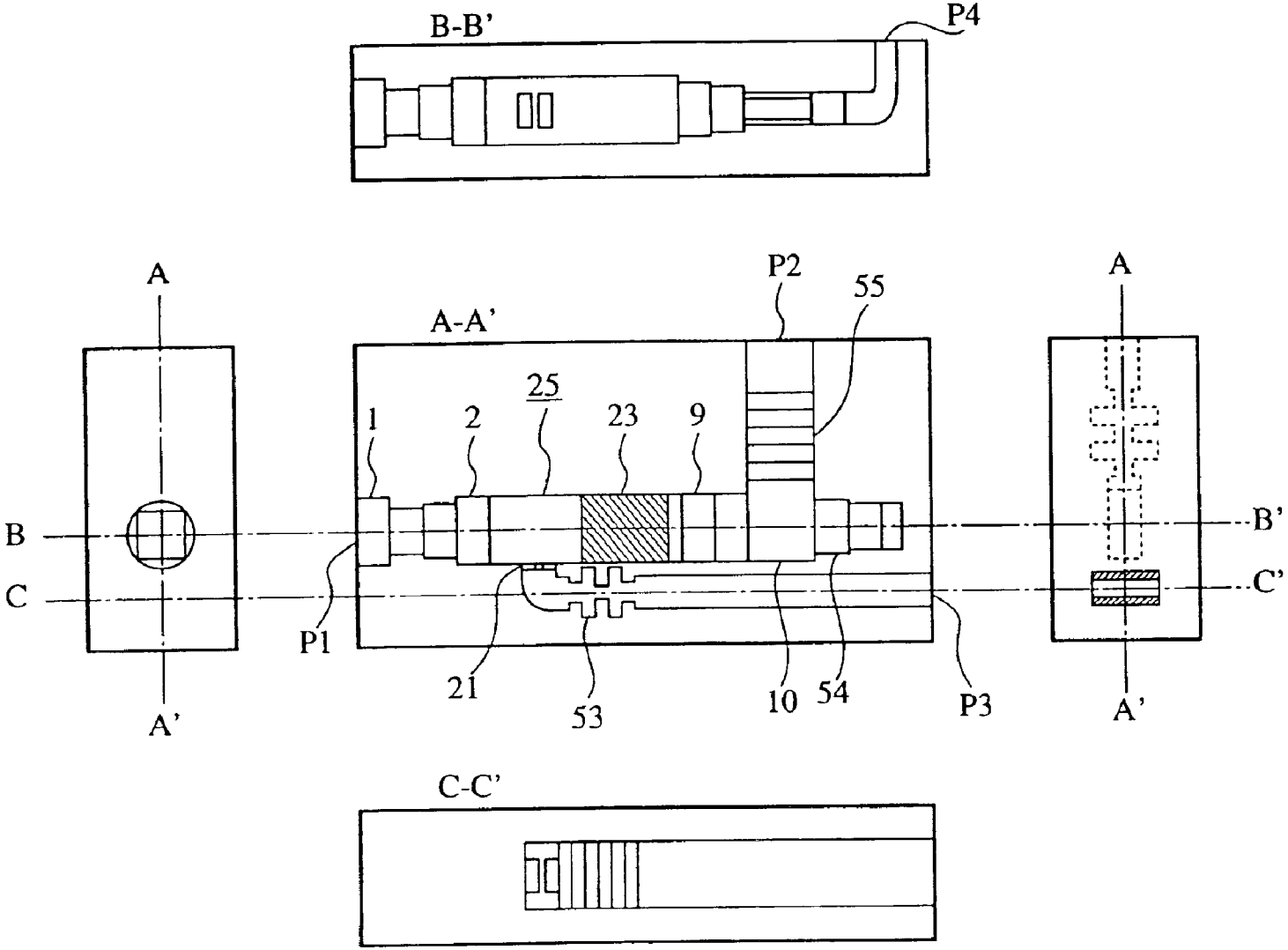
FIG. 14 is a diagrammatic showing of a waveguide group branching filter according to Embodiment 11 of the present invention.

FIG. 14 is a diagrammatic showing of a waveguide group branching filter according to Embodiment 11 of the present invention. In FIG. 14, reference numeral 53 denotes a waveguide low-pass filter connected to the branching end of the branch waveguide polarizer/branching filter 25 and formed by a corrugated rectangular waveguide; 54 denotes a waveguide high-pass filter connected to one end of the rectangular H-plane T-branch circuit and formed by a stepped rectangular waveguide; and 55 denotes waveguide low-pass filter connected to the branching end of the rectangular H-plane T-branch circuit 10 and formed by a corrugated rectangular waveguide.

In Embodiment 4 there are provided the waveguide band-pass filter 8 comprised of the rectangular waveguide 5, the coupling hole 3, the n iris-type coupling holes 6 and the n rectangular cavity resonators 7, and the waveguide band-pass filter 18 comprised of the rectangular waveguide 11, the m+1 iris-type coupling holes 12 and the n rectangular cavity resonators 17; this embodiment is identical in construction with Embodiment 4 of FIG. 5 except that the former uses, as depicted in FIG. 12, the waveguide low-pass filter 53, the waveguide high-pass filter 54 and the waveguide low-pass filter 54 in place of the waveguide band-pass filter 8, the waveguide band-pass filter 14 and the waveguide band-pass filter 18 shown in FIG. 5.

This embodiment modifies the waveguide group branching filter of Embodiment 4 to include the waveguide low-pass filter 53, the waveguide high-pass filter 4 and the waveguide low-pass filter 55; and the waveguide group branching filters of Embodiments 1 to 3 and 5 to 7 may also be modified to include the waveguide low-pass filter 53, the waveguide high-pass filter 4 and the waveguide low-pass filter 55. Further, the waveguide group branching filter of Embodiment 8 may also be modified to include two waveguide low-pass filters and two waveguide high-pass filters.

Further, while this embodiment has the waveguide low-pass filters 53 and 55 ach formed by a corrugated rectangular waveguide and the waveguide high-pass filter 54 formed by a stepped rectangular waveguide, the waveguide low-pass filters 53 and 55 and the waveguide high-pass filters may each be formed by either corrugated or stepped rectangular waveguide. The same goes for the waveguide group branching filter modified from the waveguide group branching filter of Embodiment 8.

As described above, Embodiment 11 permits realization of a high-performance waveguide group branching filter that has very excellent reflection and polarized wave isolation characteristics in the square waveguide 2 due to the vertical symmetry of the structures of the circular-to-square waveguide multistage transformer 1, the branch waveguide polarizer/branching filter 25 and the rectangular waveguide multistage transformer 9.

Further, according to Embodiment 11 since the cutoff effect of the waveguide band-pass filter 8 against the radio waves V1 and V2 in the branch waveguide polarizer/branching filter 25 having the two coupling holes 21 is heightened and since the frequency characteristic by the cutoff effect of the thin metal sheet 23 for the radio wave H1 is stable, this embodiment permits realization of a high-performance waveguide group branching filter with excellent reflection and polarized waves isolation characteristics in a wider band.

Furthermore, according to Embodiment 11, the waveguide group branching filter has a pseudo-planar circuit structure which needs only to be divided into two along the A–A' plane in FIG. 14 so that all the constituent circuits, except the thin metal sheet 23, can be formed by boring two metal blocks from their surfaces—this facilitates miniaturization and cost reduction of the waveguide group branching filter.

Besides, according to Embodiment 11, the use of the waveguide low-pass filter formed by a corrugated rectangular waveguide, the waveguide high-pass filter 54 formed by a stepped rectangular waveguide and he waveguide low-pass filer 55 formed by a corrugated rectangular waveguide permits realization of a waveguide group branching filter of a smaller pseudo-planar circuit structure.

INDUSTRIAL APPLICABILITY

As described above, the waveguide group branching filter structure according to the present invention is suitable for a high-performance waveguide group branching filter that is used in the VHF, UHF, microwave and millimeter wave bands and is easy of miniaturization and low-cost production.

What is claimed is:

1. A waveguide group branching filter comprising:

a circular-to-square waveguide multistage transformer connected to an input port;

a branch waveguide polarizer/branching filter connected to said circular-to-square waveguide multistage transformer;

a first waveguide frequency filter connected to a branching end of said branch waveguide polarizer/branching filter;

a rectangular waveguide H-plane T-branch circuit;

a rectangular waveguide multistage transformer operably connecting one end of said branch waveguide polarizer/branching filter to said rectangular waveguide H-plane T-branch circuit;

a second waveguide frequency filter connected to said rectangular waveguide H-plane T-branch circuit; and a third waveguide frequency filter connected to said rectangular waveguide H-plane T-branch circuit;

wherein:

a first radio wave of a first frequency band which has the polarization plane perpendicular to a branch plane of said waveguide polarizer/branching filter, a second radio wave of said first frequency band which has the polarization plane parallel to the branch plane of said branch waveguide polarizer/branching filter, and a third radio wave of a second frequency band higher than said first frequency band which has the same polarization plane as that of said first radio wave are incident to said input port; and said first radio wave is cut off by said first and second waveguide frequency filters and is emitted from said third waveguide frequency filter, said second radio wave is cut off by said rectangular waveguide multistage transformer and is emitted from said first waveguide frequency filter, and said third radio wave is cut off by said first and third waveguide frequency filters and is emitted from said second waveguide frequency filter.

2. The waveguide group branching filter according to claim 1, wherein the branch waveguide polarizer/branching filter is formed by a square waveguide and a single coupling hole formed for coupling said first waveguide frequency filter through one side wall of the square waveguide at the branching end of said branch waveguide polarizer/branching filter.

3. The waveguide group branching filter according to claim 1, characterized in that the branch waveguide polarizer/branching filter is formed by a square waveguide and two coupling holes formed through one side wall of the square waveguide at the branching end of said branch waveguide polarizer/branching filter.

4. The waveguide group branching filter according to claim 1, wherein the branch waveguide polarizer/branching filter is formed by a square waveguide, a single coupling hole formed for coupling said first waveguide frequency filter through one side wall of the square waveguide at the branching end of said branch waveguide polarizer/branching filter and a thin metal sheet inserted in said square waveguide.

5. The waveguide group branching filter according claim 1, characterized in that the branch waveguide polarizer/branching filter is formed by a square waveguide, two coupling holes formed through one side wall of the square waveguide at the branching end of said branch waveguide polarizer/branching filter and a thin metal sheet inserted in said square waveguide.

6. The waveguide group branching filter according to claim 1, further comprising a circularly polarized wave generator connected between the input port and the circular-to-square waveguide multistage transformer and composed of a circular waveguide and a dielectric plate inserted in the circular waveguide.

7. The waveguide group branching filter according to claim 1, further comprising a circularly polarized wave generator connected between the input port and the circular-to-square waveguide multistage transformer and composed of a circular waveguide and a plurality of metal pins mounted on the side wall of the circular waveguide.

8. The waveguide group branching filter according to claim 1, further comprising a circularly polarized wave generator connected between the input port and the circular-to-square waveguide multistage transformer and composed of a circular waveguide and a plurality of grooves cut in the side wall of the circular waveguide.

9. The waveguide group branching filter according to claim 1, wherein the first, second and third waveguide frequency filters are waveguide band-pass filters and wherein:

the first waveguide band-pass filter is formed by n rectangular cavity resonators and n iris-type coupling holes;

the second waveguide band-pass filter is formed by m rectangular cavity resonators and m+1 iris-type coupling holes; and the third waveguide band-pass filter is formed by n rectangular cavity resonators and n+1 iris-type coupling holes.

10. The waveguide group branching filter according to claim 1, wherein the first, second and third waveguide frequency filters are waveguide band-pass filters and wherein:

the second waveguide band-pass filter is formed by m rectangular cavity resonators and 2m+2 post-type coupling holes; or the third waveguide band-pass filter is formed by n rectangular cavity resonators and 2n+2 post-type coupling holes.

11. The waveguide group branching filter according to claim 1, wherein the first, second and third waveguide frequency filters are waveguide band-pass filters and wherein:

the second waveguide band-pass filter is formed by m rectangular cavity resonators and 3m+3 double-post-type coupling holes; or the third waveguide band-pass filter is formed by n rectangular cavity resonators and 3n+3 double-post-type coupling holes.

12. The waveguide group branching filter according to claim 1, wherein:

at least one of the first and third waveguide frequency filters is a waveguide low-pass filter formed by a corrugated or stepped rectangular waveguide.

13. The waveguide group branching filter according to claim 1, wherein:

the second waveguide frequency filter is replaced with a waveguide high-pass filter formed by a corrugated or stepped rectangular waveguide.

14. The waveguide group branching filter according to claim 1, further comprising:

a rectangular waveguide E-plane T-branch circuit connected to the branching end of the branch waveguide polarizer/branching filter and the first waveguide band-pass filter; and a fourth waveguide frequency filter connected to the rectangular waveguide E-plane T-branch circuit, wherein:

a fourth radio wave of the second frequency band which has the same polarization plane as that of the second radio wave is incident to the input port, the fourth radio wave being cut off by said branch waveguide polarizer/branching filter and first waveguide frequency filter and being emitted from said fourth waveguide frequency filter.

15. The waveguide group branching filter according to claim 14, wherein:

the first and third waveguide frequency filters are waveguide band-pass filters each formed by n rectangular cavity resonators and n+1 iris-type coupling holes; and the second and fourth waveguide frequency filters are waveguide band-pass filters each formed by m rectangular cavity resonators and m+1 iris-type coupling holes.

16. The waveguide group branching filter according to claim 14, wherein the fourth waveguide frequency filter is a waveguide high-pass filter formed by a corrugated or stepped rectangular waveguide.

17. A waveguide group branching filter comprising:

a bore within a solid metal block, the bore including portions of varying shapes including, a transforming portion configured to receive a plurality of radio waves from an input port and transform the received radio waves from modes compatible with circular waveguides to modes compatible with rectangular waveguides;

a branching portion operably connected to the transforming portion; and a plurality of waveguide filtering portions operably connected to the branching portion, wherein the branching portion is configured to route the transformed radio waves to the waveguide filtering portions, the waveguide filtering portions being configured to emit each of the transformed radio waves through a corresponding one of a plurality of output ports.

18. The waveguide group branching filter according to claim 17, wherein the bore further comprises:

a rectangular waveguide multistage transforming portion operably connecting the branching portion to the waveguide filtering portions, the rectangular waveguide multistage transforming portion being configured to reflect transformed radio waves of a first polarization plane and accept radio waves of a second polarization plane, wherein the waveguide filtering portions include a first, second and third waveguide filtering portions, the first waveguide filter being operable to filter a predetermined radio wave and to emit the reflected radio waves through a first output port, the second and third waveguide filters being configured to filter predetermined radio waves and to emit selected ones of the accepted radio waves through second and third output ports, respectively.

19. The waveguide group branching filter according to claim 18, wherein the first, second and third waveguide filtering portions are configured as waveguide band-pass filters.

20. The waveguide group branching filter according to claim 19, wherein the first waveguide filtering portion includes n ($n \geqq 1$) rectangular cavity resonators and n iris-type coupling holes.

21. The waveguide group branching filter according to claim 20, wherein the second waveguide filtering portion includes m ($m \geqq 1$) rectangular cavity resonators and m+1 iris-type coupling holes; and the third waveguide filtering portion includes n rectangular cavity resonators and n+1 iris-type coupling holes.

22. The waveguide group branching filter according to claim 19, wherein the second waveguide filtering portion includes m ($m \geqq 1$) rectangular cavity resonators and 2m+2 post-type coupling holes; and the third waveguide filtering portion includes n ($n \geqq 1$) rectangular cavity resonators and 2n+2 post-type coupling holes.

23. The waveguide group branching filter according to claim 19, wherein the second waveguide filtering portion includes m ($m \geqq 1$) rectangular cavity resonators and 3m+3 post-type coupling holes; and the third waveguide filtering portion includes n ($n \geqq 1$) rectangular cavity resonators and 3n+3 post-type coupling holes.

24. The waveguide group branching filter according to claim 19, wherein at least one of the waveguide filtering portions is configured as a corrugated or stepped rectangular waveguide.

25. The waveguide group branching filter according to claim 24, wherein the corrugated or stepped rectangular waveguide is configured to operate as a lowpass filter.

26. The waveguide group branching filter according to claim 24, wherein the corrugated or stepped rectangular waveguide is configured to operate as a highpass filter.

27. The waveguide group branching filter according to claim 24, wherein the second waveguide filtering portion is configured to operate as a lowpass filter, and the third waveguide filtering portion is configured to operate as a highpass filter.

28. The waveguide group branching filter according to claim 17, wherein the branching portion is a rectangular waveguide, further comprising a metal sheet disposed within the branching portion.

29. The waveguide group branching filter according to claim 17, wherein the transforming portion includes, a polarizing portion configured to polarize the received radio waves as right- and left-handed polarized radio waves, the transforming portion being configured to transform the polarized waves from modes compatible with circular waveguides to modes compatible with rectangular waveguides.

30. The waveguide group branching filter according to claim 29, wherein the polarizing portion is configured as a circular waveguide in which a dielectric sheet is disposed.

31. The waveguide group branching filter according to claim 29, wherein the polarizing portion is configured as a circular waveguide and a plurality of metal pins mounted on a sidewall of the circular waveguide.

32. The waveguide group branching filter according to claim 29, wherein the polarizing portion is configured as a circular waveguide whose sidewall includes a plurality of grooves.

33. A method of manufacturing a waveguide group branching filter, comprising:

boring surfaces of each of two metal blocks, wherein a circuit structure is formed by the two bored surfaces, when the metal blocks are assembled together, the circuit structure being operable to receive a plurality radio waves, transform the received radio waves from modes compatible with circular waveguides into modes compatible with rectangular waveguides, and filtering the transformed radio waves, and emitting each filtered radio wave from a corresponding one of a plurality of output ports.

34. The method according to claim 33, wherein the boring step includes:

boring portions of the surface of each metal block so that, when the metal blocks are assembled together, the circuit structure includes:

a transforming portion configured to receive a plurality of radio waves from an input port and transform the received radio waves from modes compatible with circular waveguides to modes compatible with rectangular waveguides;

a branching portion operably connected to the multistage portion; and a plurality of waveguide filtering portions operably connected to the branching portion, wherein the branching portion is configured to route the transformed radio waves to the waveguide filtering portions, the waveguide filtering portions being configured to filter predetermined radio waves and to emit each of the transformed radio waves through a corresponding one of a plurality of output ports.

35. The method according to claim 34, wherein the boring step includes, boring a portion of the surface of each metal block so that, when the metal blocks are assembled together, the circuit structure further includes:

a rectangular waveguide multistage transforming portion operably connecting the branching portion to the waveguide filtering portions, the rectangular waveguide multistage transforming portion being configured to reflect transformed radio waves of a first polarization plane and accept radio waves of a second polarization plane, wherein the waveguide frequency filtering portions include a first, second and third waveguide frequency filtering portions, the first waveguide frequency filter being operable to filter a predetermined radio wave and to emit the reflected radio waves through a first output port, the second and third waveguide frequency filters being configured to filter predetermined radio waves and to emit selected ones of the accepted radio waves through second and third output ports, respectively.

36. The method according to claim 34, wherein the boring step includes, boring a portion of the surface of each metal block so that, when the metal blocks are assembled together, the circuit structure further includes:

a polarizing portion configured to polarize the received radio waves as right- and left-handed polarized radio waves, the transforming portion being configured to transform the polarized waves from modes compatible with circular waveguides to modes compatible with rectangular waveguides.

37. A waveguide group branching filter manufactured according to the method of claim 34.

* * * * *